US010024631B2

(12) United States Patent
Portoghese et al.

(10) Patent No.: US 10,024,631 B2
(45) Date of Patent: Jul. 17, 2018

(54) MODULAR ADVANCED TECHNOLOGY MARKSMANSHIP PROFICIENCY SYSTEM

(71) Applicants: Rocco Portoghese, Winter Park, FL (US); Tyson Griffin, Oviedo, FL (US); Joseph Brian Vanciel, Orlando, FL (US); Paul Geoffrey Barber, Orlando, FL (US); Matthew James Lankford, Oviedo, FL (US); Richard Hebb, Orlando, FL (US); Thomas James Foster, Orlando, FL (US); Ryan Matthew Faircloth, Orlando, FL (US); Matthew Paul Adams, Orlando, FL (US)

(72) Inventors: Rocco Portoghese, Winter Park, FL (US); Tyson Griffin, Oviedo, FL (US); Joseph Brian Vanciel, Orlando, FL (US); Paul Geoffrey Barber, Orlando, FL (US); Matthew James Lankford, Oviedo, FL (US); Richard Hebb, Orlando, FL (US); Thomas James Foster, Orlando, FL (US); Ryan Matthew Faircloth, Orlando, FL (US); Matthew Paul Adams, Orlando, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 396 days.

(21) Appl. No.: 14/872,457

(22) Filed: Oct. 1, 2015

(65) Prior Publication Data

US 2017/0097209 A1 Apr. 6, 2017

(51) Int. Cl.

| | |
|---|---|
| ***F41G 3/26*** | (2006.01) |
| ***G07C 3/02*** | (2006.01) |
| ***F41G 11/00*** | (2006.01) |

(52) U.S. Cl.

CPC ..... *F41G 3/2605* (2013.01); *F41G 3/26* (2013.01); *F41G 11/001* (2013.01); *G07C 3/02* (2013.01)

(58) Field of Classification Search

CPC ..... F41G 3/26; F41G 3/2605; F41G 11/001; G07C 3/02

See application file for complete search history.

(56) References Cited

U.S. PATENT DOCUMENTS 5,629,673 A * 5/1997 Juhasz ..... A41D 13/0151 2/94

2008/0233543 A1* 9/2008 Guissin ..... F41A 33/00 434/19

* cited by examiner

*Primary Examiner* — Timothy A Musselman

(74) *Attorney, Agent, or Firm* — Mark O. Glut; Charles Buskey; NAWCAD

(57) ABSTRACT

Disclosed is a modular advanced technology -marksmanship proficiency (MAT-MP) system. The MAT-MP system provides marksmanship instructors with a robust and reconfigurable set of technological tools to quickly diagnose and remediate deficiencies in marksmanship skill at a live-fire range. The system diagnoses the shooter's performance using an array of sensors and an optic camera, all placed on the shooter's weapon, to continuously monitor and record his/her performance during weapon fire. Data output by the sensors and optic camera is gathered by the MAT-MP system's weapon-mounted control device and sent wirelessly to an instructor station, typically a tablet, laptop computer or the like. The MAT-MP coach software running on the instructor's computer presents a summarized analysis of the shooter's performance as well as provides the instructor the ability to view the raw sensor data graphically. The (Continued)

MAT-MP system can enable the instructor to more quickly identify and confirm the root cause of the shooter's poor performance instead of forcing the instructor to rely upon heuristic methods and interpretation of the fall of shot.

48 Claims, 26 Drawing Sheets

MODULAR ADVANCED TECHNOLOGY MARKSMANSHIP PROFICIENCY SYSTEM

STATEMENT OF GOVERNMENT INTEREST

The invention described herein may be manufactured and used by or for the Government of the United States of America for governmental purposes without payment of any royalties thereon or therefore.

BACKGROUND

Marksmanship is a foundational skill required of soldiers, law enforcement personnel and any civil servant entrusted with a firearm. Great emphasis is placed upon the acquisition and maintenance of marksmanship skill throughout a soldier's or civil servant's career.

The marksmanship instructor is the shooter's first and best resource for the acquisition and maintenance of this vital skill. The marksmanship instructor faces many demands upon his/her time and abilities. In modern military and law enforcement firing ranges, each instructor typically oversees four students simultaneously. Time on the firing range and ammunition for training is limited and expensive. Any deficiencies in a particular shooter's performance that require a disproportionate amount of an instructor's time to diagnose and remediate takes instruction away from the other shooters. Reshoots and retries consume both valuable time and ammunition. Furthermore, a shooter that cannot demonstrate proper marksmanship at the range quickly enough is in danger of being removed from the firing line and forced to repeat more basic training, incurring more expense.

The marksmanship instructor is tasked with teaching his/her students the fundamentals of marksmanship in the safest, quickest and most effective way possible. The Armed Services have identified several marksmanship fundamentals including aiming, breath control, trigger squeeze and steady position. If a shooter is not accurate, she is usually deficient in one or more of these fundamentals. However, the root cause of a shooter's poor marksmanship is not always readily apparent even to an experienced instructor.

The difficulty and danger of close observation of the shooter at the live fire range, the small physical differences between acceptable and poor weapon handling, and the extremely transient nature of firing events force instructors to very often rely solely on the most heuristic measure of performance available to them: the fall of shot. A poor fall of shot, however, is only the symptom of poor marksmanship. The marksmanship instructor often cannot determine in which fundamental the shooter is lacking solely from their fall of shot.

Therefore marksmanship instructors need something to aid them in monitoring marksmanship fundamentals. Technology that can mitigate these inherent difficulties and expose the root causes of poor marksmanship will increase the marksmanship instructor's efficiency, effectiveness and analytic capability and is consequently of great value to both the instructor and the student.

SUMMARY

The current invention is a modular advance technology—marksmanship proficiency (MAT-MP) system. The Naval Air Warfare Center Training Systems Division (NAWCTSD) developed the MAT-MP system in an effort to provide the marksmanship instructor with a robust and reconfigurable set of technological tools to quickly diagnose and remediate deficiencies in marksmanship skill at a live-fire range. The system's diagnosis of the shooter's performance is enabled by an array of sensors and an optic camera all placed on the shooter's weapon to continuously monitor and record his/her performance during weapon fire. Data output by the sensors and optic camera is gathered by the MAT-MP system's weapon-mounted control device and sent wirelessly to an instructor station, typically a tablet, laptop computer or the like. The MAT-MP coach software running on the instructor's computer presents a summarized analysis of the shooter's performance as well as providing the instructor the ability to view the raw sensor data graphically in real time The MAT-MP system can enable the instructor to more quickly identify and confirm the root cause of the shooter's poor performance instead of forcing the instructor to rely upon heuristic methods and interpretation of the fall of shot.

The sensors included in embodiments of the MAT-MP system are a finger pressure weapon trigger sensor and a weapon buttstock pressure sensor. A combat optic camera and a remote reconfigurable data collector (R2DC), the controlling intelligence of the $MAT_{MP}$ system, are also included as part of the MAT-MP system. All of these devices are robust, capable of surviving the forces of live fire, can be installed and uninstalled in seconds without any special tools and do not require any modifications to the weapon or its accessories. The devices are also of a size and weight comparable to weapon-mounted tactical devices that many marksmen are already accustomed to Most importantly, the MAT-MP system does not affect the weapon's aim point or sight zero, and does not interfere with the operation, feel or handling of the weapon.

While only trigger pressure and buttstock pressure sensors are captured in embodiments of the current invention, similar sensors including, but not limited to, accelerometers and compasses are also contemplated and can be easily incorporated into the MAT-MP system.

The weapon trigger finger pressure sensor is a device that can be easily inserted into the weapon trigger well, and incorporates force sensitive resistors onto the trigger to measure the finger pressure the shooter exerts on the trigger while shooting without interfering with the feel or operation of the weapon. The sensor captures the trigger pressure data and transmits it to the remote reconfigurable data collector. The sensor of the present invention is separable from the system's controlling intelligence and inexpensive enough to be effectively disposable.

The weapon buttstock pressure monitoring sensor comprises a buttstock body that forms and easily attaches to the weapon buttstock. Pressure monitoring sensors are incorporated onto the end of the buttstock body to measure the pressure applied to the weapon's buttstock while in the shooter's shoulder pocket during firing. The sensor captures this data and transmits it to the remote reconfigurable data collector.

A high definition combat optic camera attaches to the eyepiece of the weapon's optic device, typically a combat optic scope. The camera captures full field view video of the shooter's sight alignment and sight picture and transmits the uncompressed video to the remote reconfigurable data collector via a connection cable. The remote reconfigurable data collector provides power to the camera through the same connection cable. The video data is processed by the remote reconfigurable data collector and correlated with the data collector's internal accelerometers as well as the other weapon-mounted MAT-MP sensor data to determine the occurrence of a shot. The video and sensor data is digitally tagged with timestamp metadata and digitally compressed by the remote reconfigurable data collector. The compressed video and sensor data is transmitted by the remote reconfigurable data collector via wireless Ethernet to a recorder application where it is archived. The instructor interface decompresses the video and sensor data and displays it within a custom viewing application supporting marksmanship training. This allows the instructor to observe the weapon sensor data as well as see everything that the shooter sees while handling his weapon in both real-time and during after action review.

With regard to aim, a shooter can increase her aim accuracy by using a scope. In order to make accurate assessments, a marksmanship instructor, either personally or with the help of a device, would like to see the shooter's exact perspective through the scope to determine any deficiencies in the shooter's ability to obtain and maintain proper sight alignment, sight picture and aim point without being intrusive to the shooter, disturbing her shot, or modifying her weapon.

Currently there are adaptors that attach a camera to weapon optical devices, including microscopes, telescopes, rifle scopes, and spotting scopes. However, these adaptors are intrusive because they do not allow the user to continue looking through the optical device. Instead, the user must observe through the camera image only. In other instances, miniature and micro cameras have been permanently embedded in the optical device either as a primary or secondary feature. However, these devices require weapon and/or sight modification. Other products have even used optical beam splitting to provide a light path to both the camera and the user's eye. However, these devices interfere with the normal operation or feel of the weapon, and they are not capable of providing a network-based, high definition digital image supporting the diagnosis and remediation of the shooter's performance.

Consequently, the video data management system of the current invention is easily installed and removed from a shooter's weapon, allows the shooter to use the weapon without any interference or modification and captures the field of view perspective for analysis. The video data management and processing application of the current invention are closely integrated with a physical camera device on the shooter's weapon, as well as the weapon-mounted sensors to automatically detect the occurrence of a round being fired and digitally tag the video with timestamp metadata pertaining to each shot. The camera has a mounting mechanism that will withstand both the rigors of rifle recoil and weapon handling. The camera also has tolerances to accommodate variances in the mounting surface diameters. In addition, the camera attaches to a trainee's issued weapon combat optic, to provide digital high definition full field of view video. The camera requires no modifications to the weapon or optic, is installed and uninstalled in seconds, is self-centering, self-aligning, requires no tools to install or remove, and does not interfere with the operation or feel of the weapon.

The controlling intelligence of the MAT-MP system is a remote reconfigurable data collector (R2DC). The R2DC powers, captures, scales and/or filters, as required, the output of the attached sensors and camera. It also polls, monitors and stores these analog and digital values with embedded intelligence. The R2DC time-stamps all incoming sensor data and video frames to ensure synchronization and correlation between all data sources. The data packets are transmitted by the R2DC to the MAT-MP video management software system running on an instructor station where it is analyzed, separated into individual shots and stored based on the shooter's identification and training stage. The data for each shot can then be evaluated for proper aim point, hold, and weapon handling technique leading up to and following each round fired by the shooter.

DRAWINGS

The features, aspects and advantages of the present invention are shown with reference to the following description, appended claims, and accompanying drawings wherein:

Figure 15:
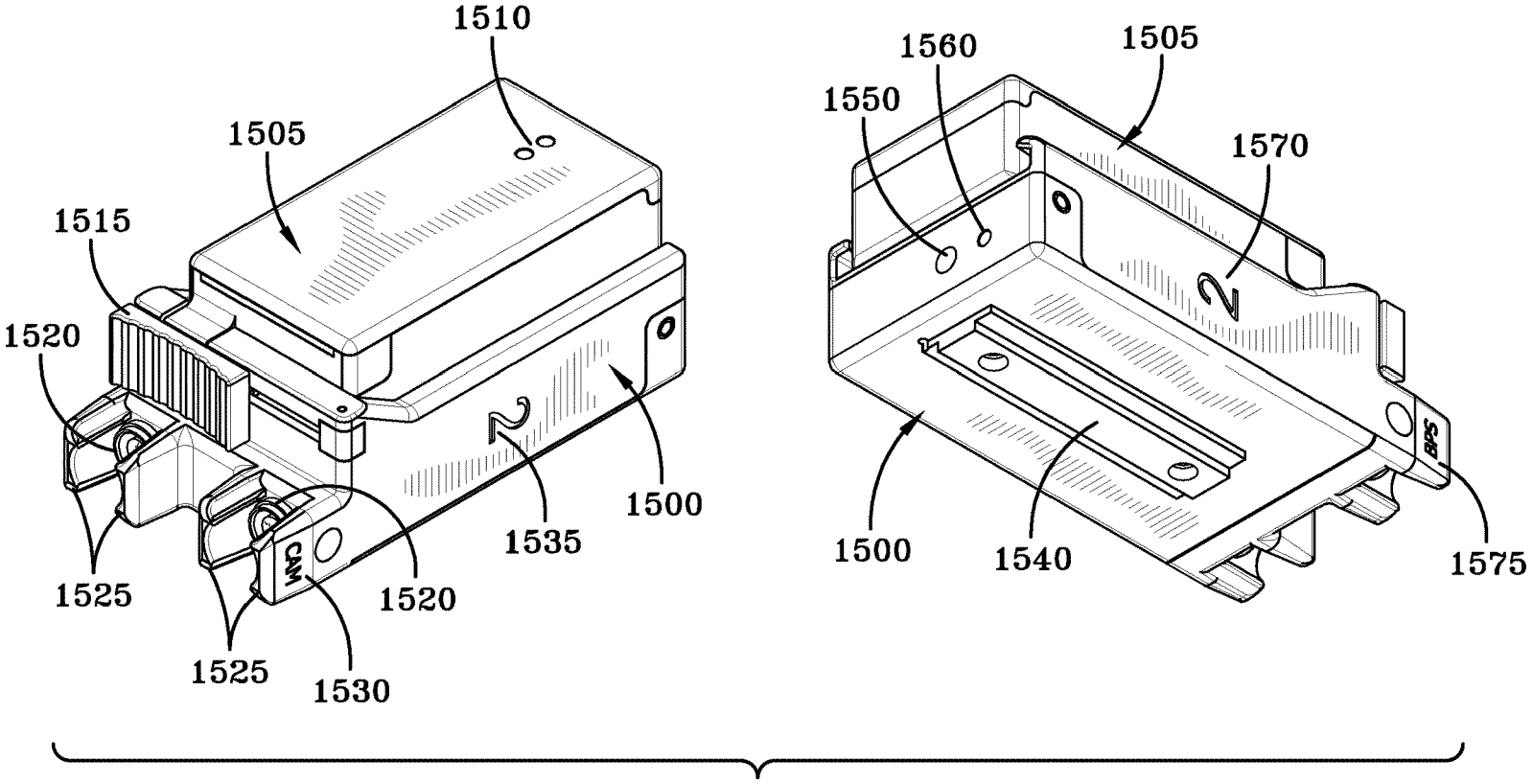

FIG. 15 includes two perspective views of the external features of an R2DC system.

Figure 15A:
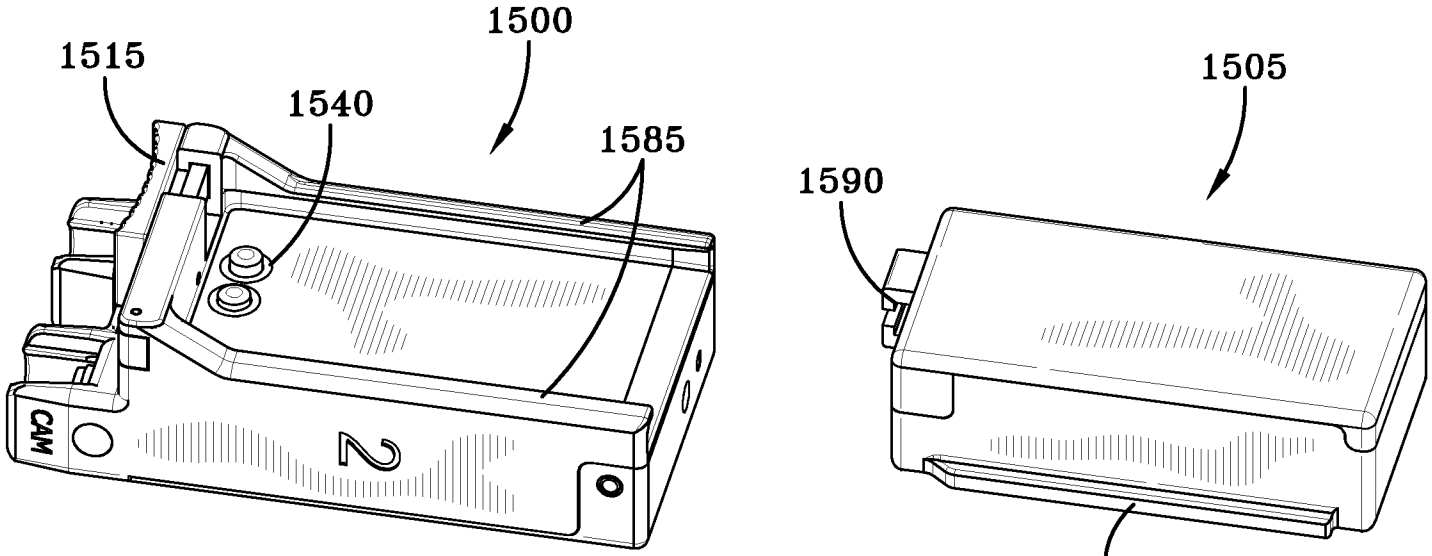

FIG. 15A shows an R2DC main body and R2DC battery separated.

Figure 16:
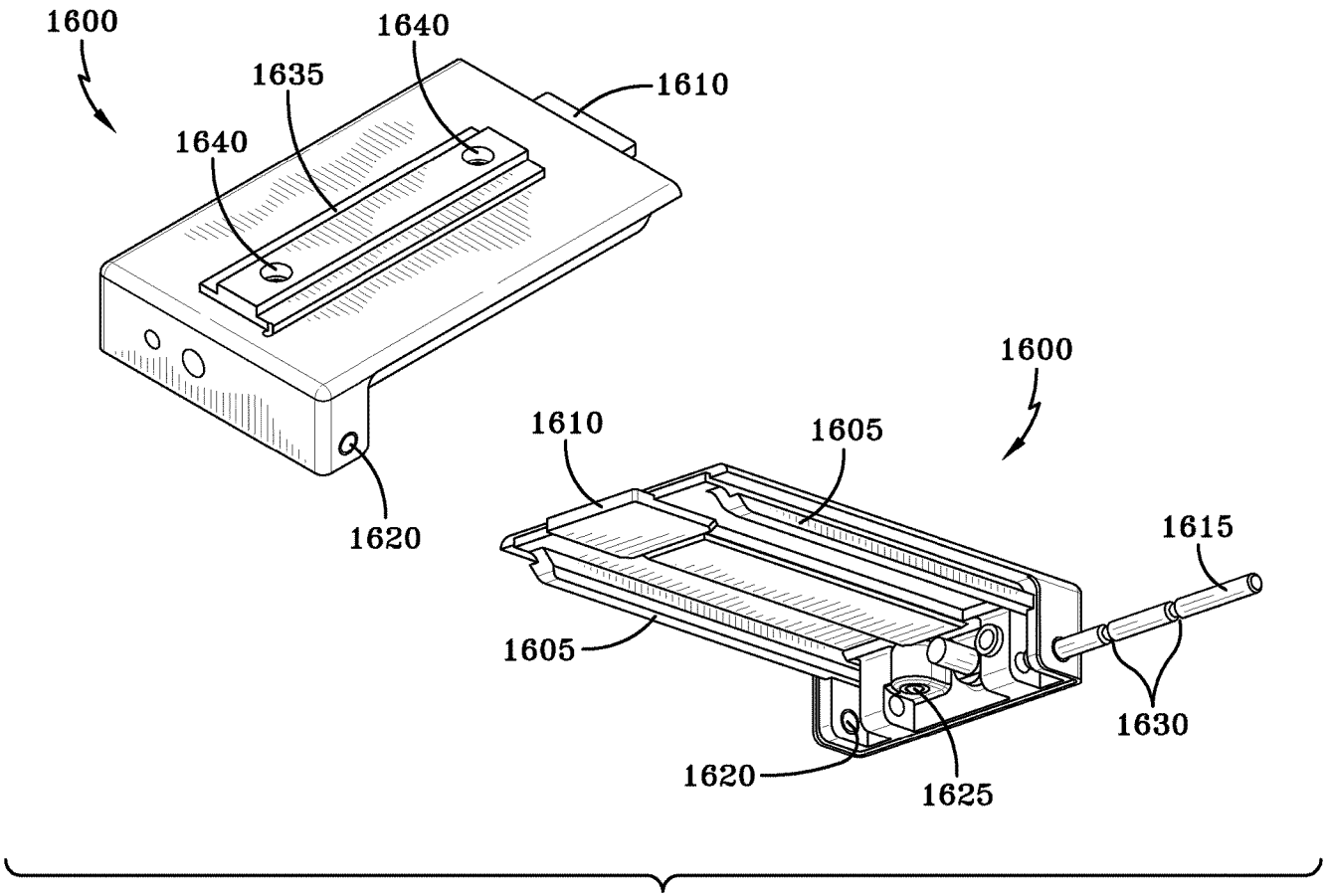

FIG. 16 shows two views of the R2DC cover.

Figure 17:
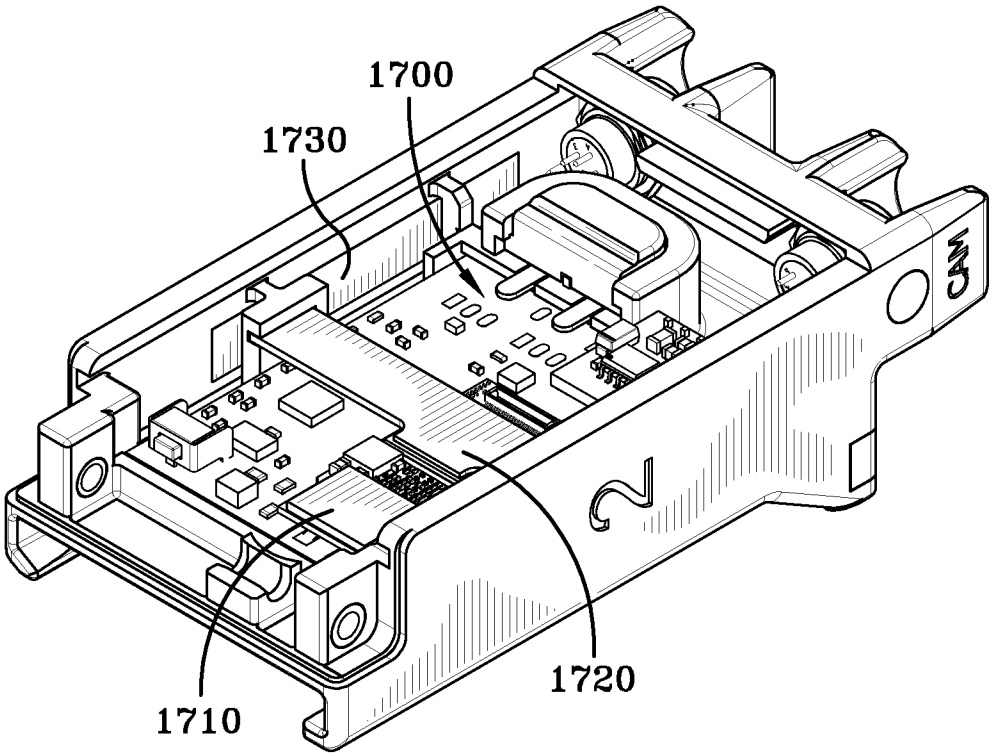

FIG. 17 is a perspective view of the interior of an R2DC with cover removed.

Figure 18:
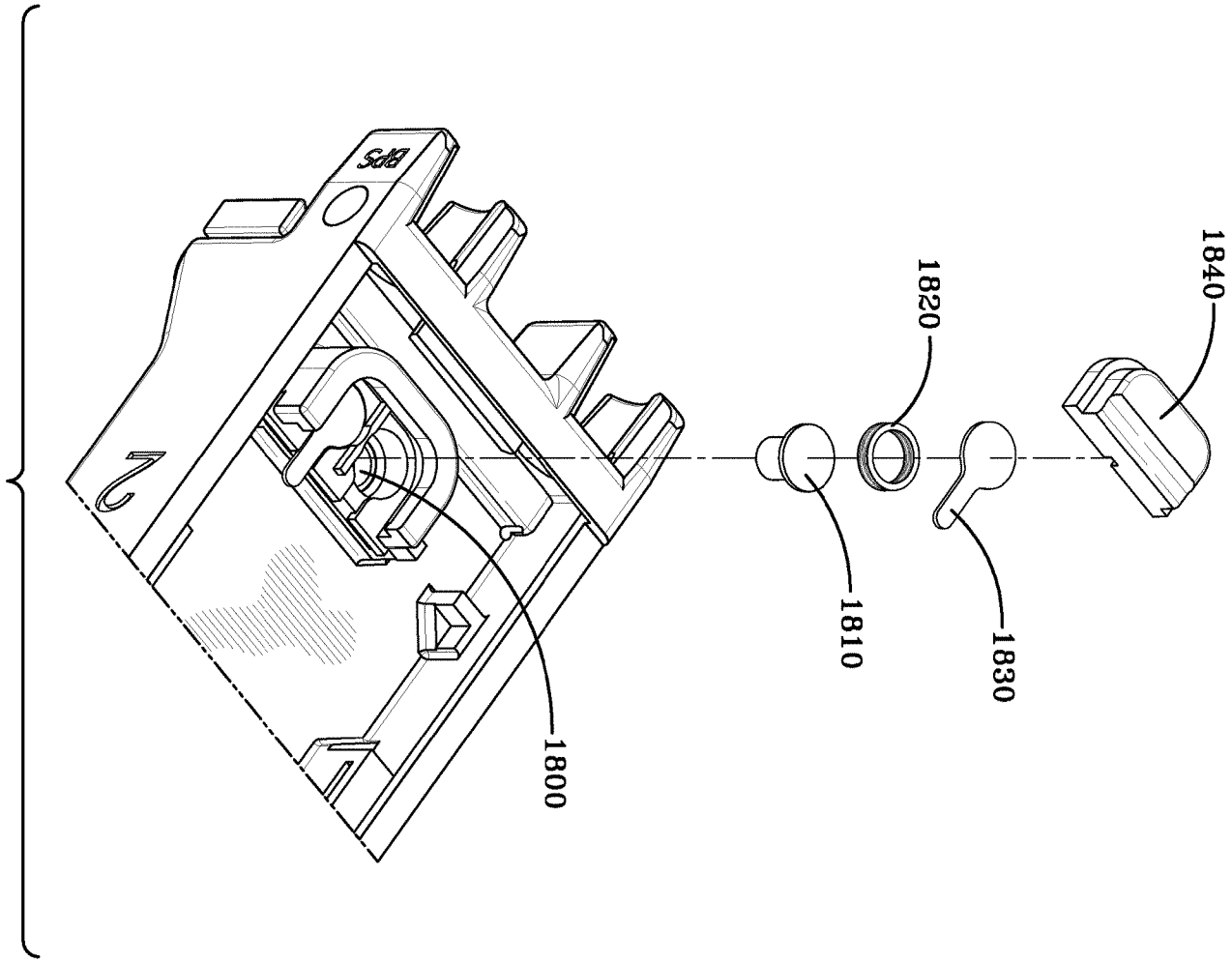

FIG. 18 is an exploded view of the R2DC battery contact component stack.

Figure 19:
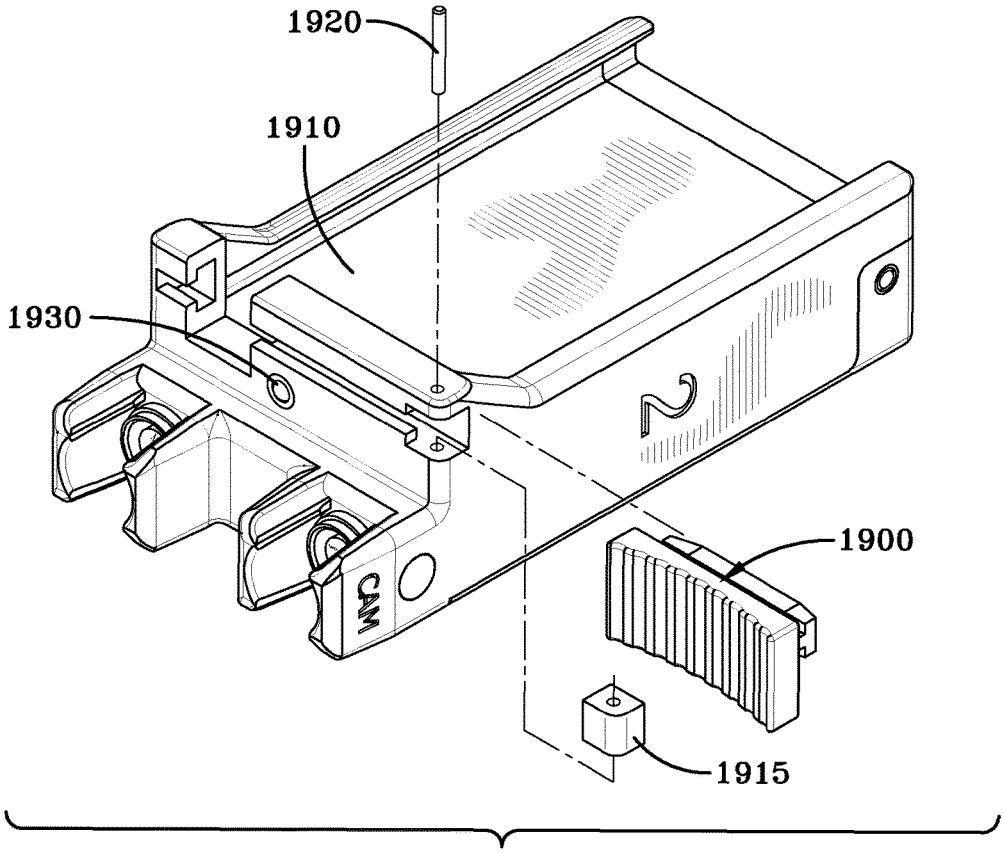

FIG. 19 is an exploded diagram of the R2DC battery retention mechanism.

Figure 19A:
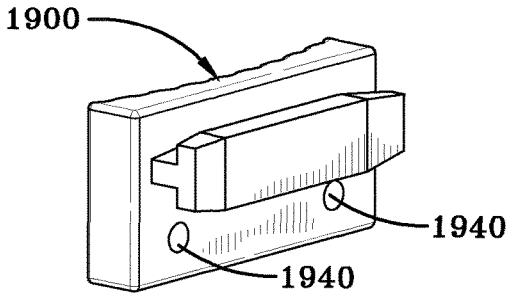

FIG. 19A shows a perspective view of the battery retention slide.

Figure 20A:
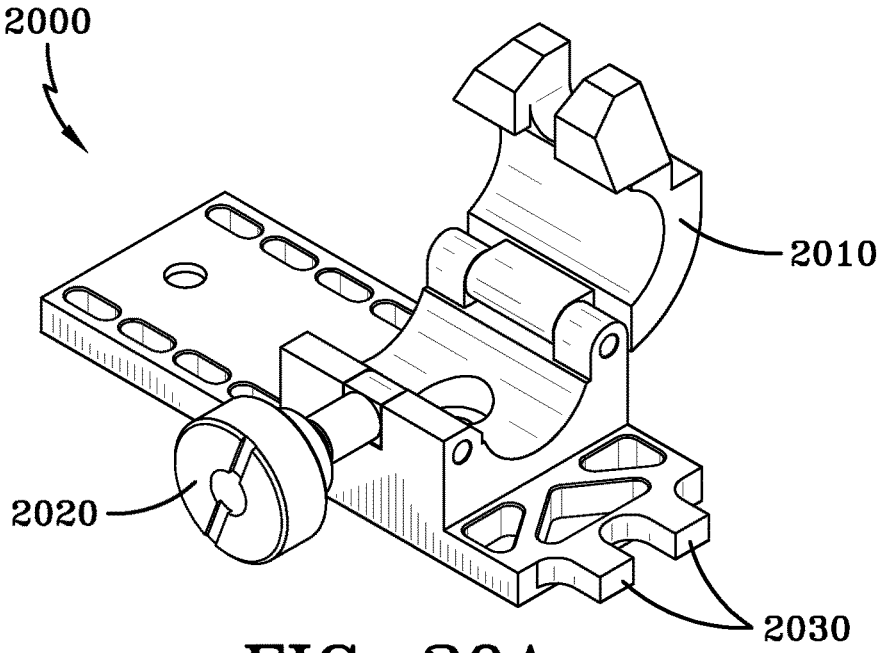

FIG. 20A is a perspective view of exemplary R2DC mounts in an open position.

Figure 20B:
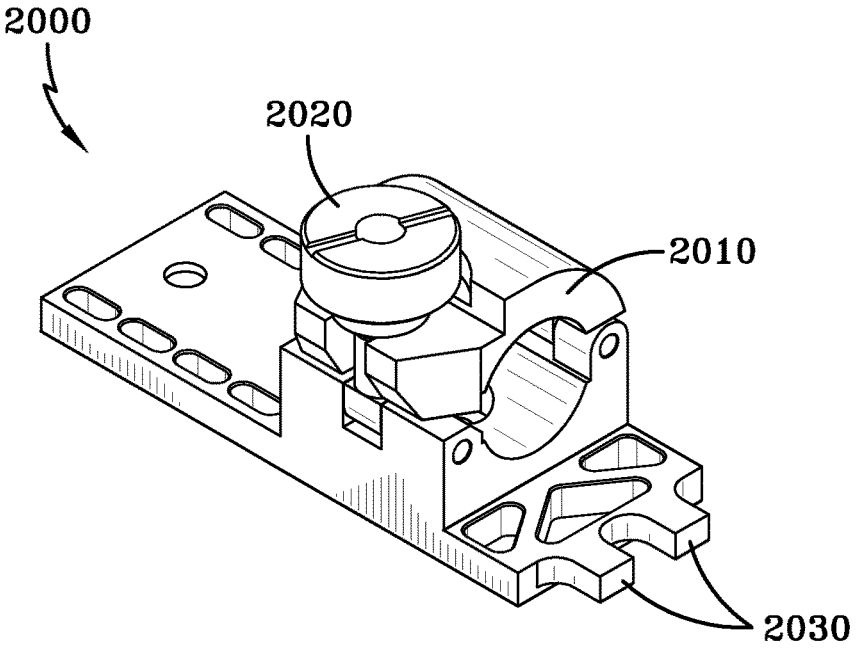

FIG. 20B is a perspective view of exemplary R2DC mounts in a closed position.

Figure 21:
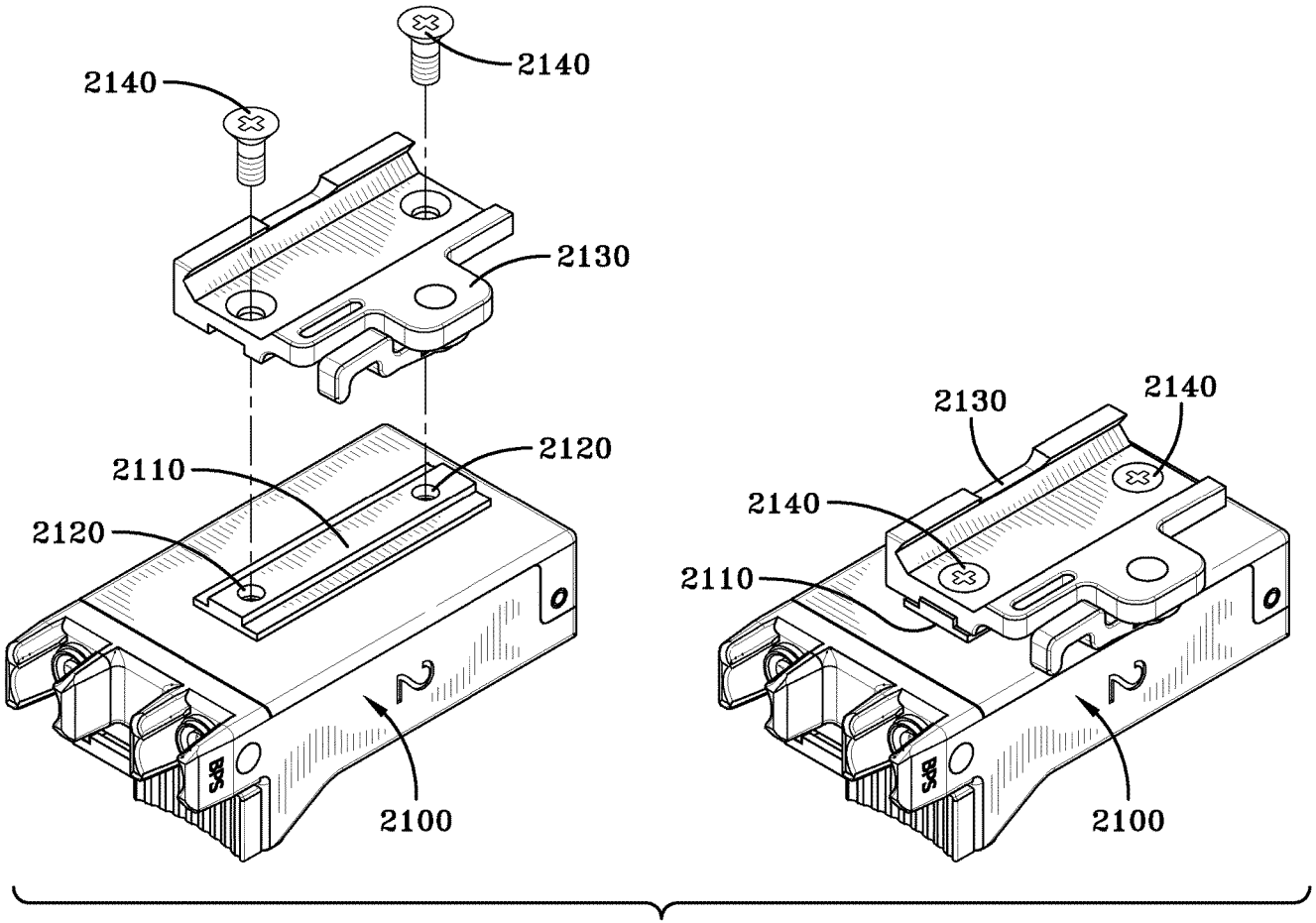

FIG. 21 shows perspective views of a quick-disconnect mount installation.

Figure 22:
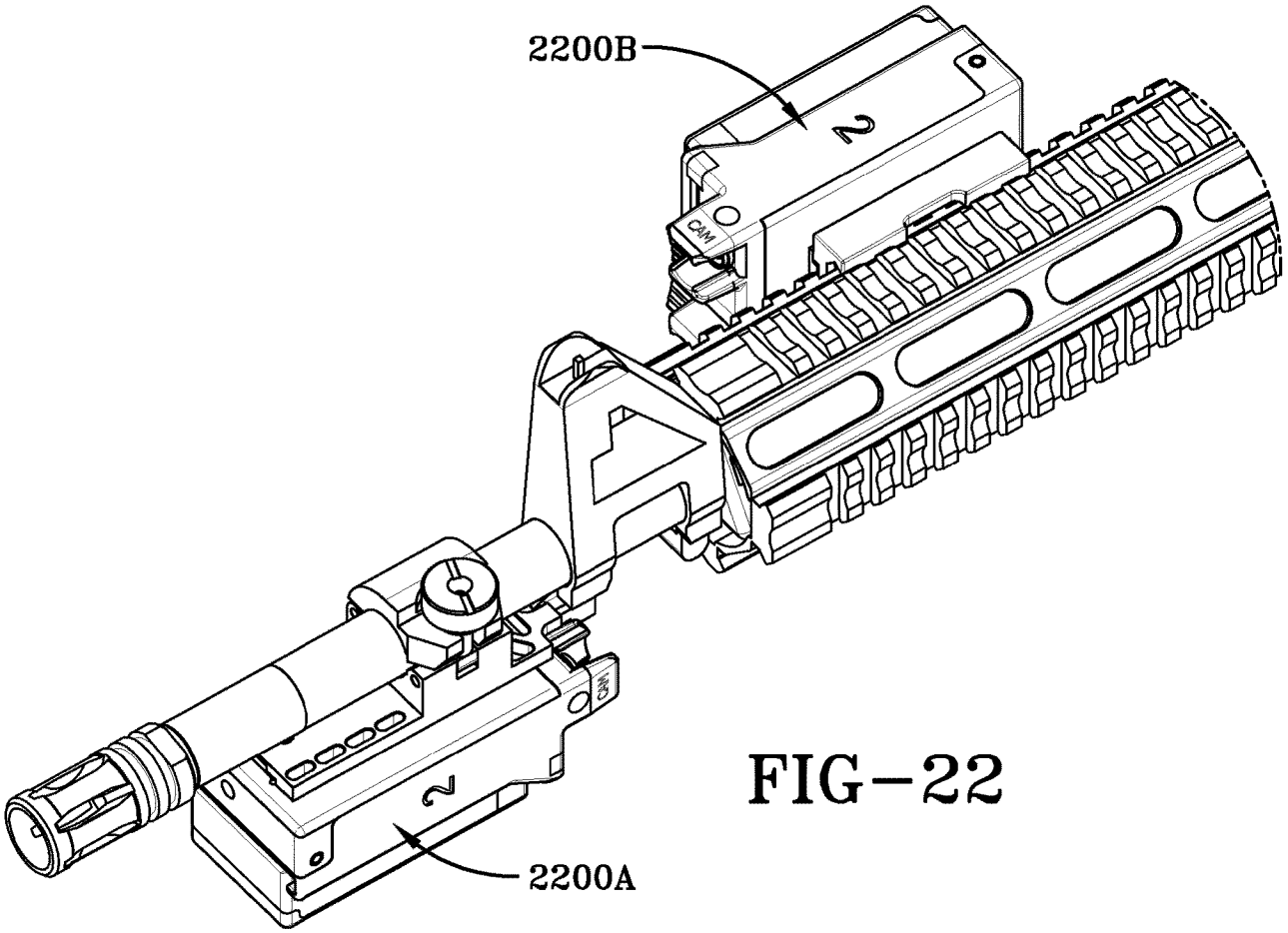

FIG. 22 shows the R2DC mounted in two different locations on a weapon.

DESCRIPTION

In the following description of the present invention, reference will be made to various embodiments which are not meant to be all inclusive.

Figure 1:
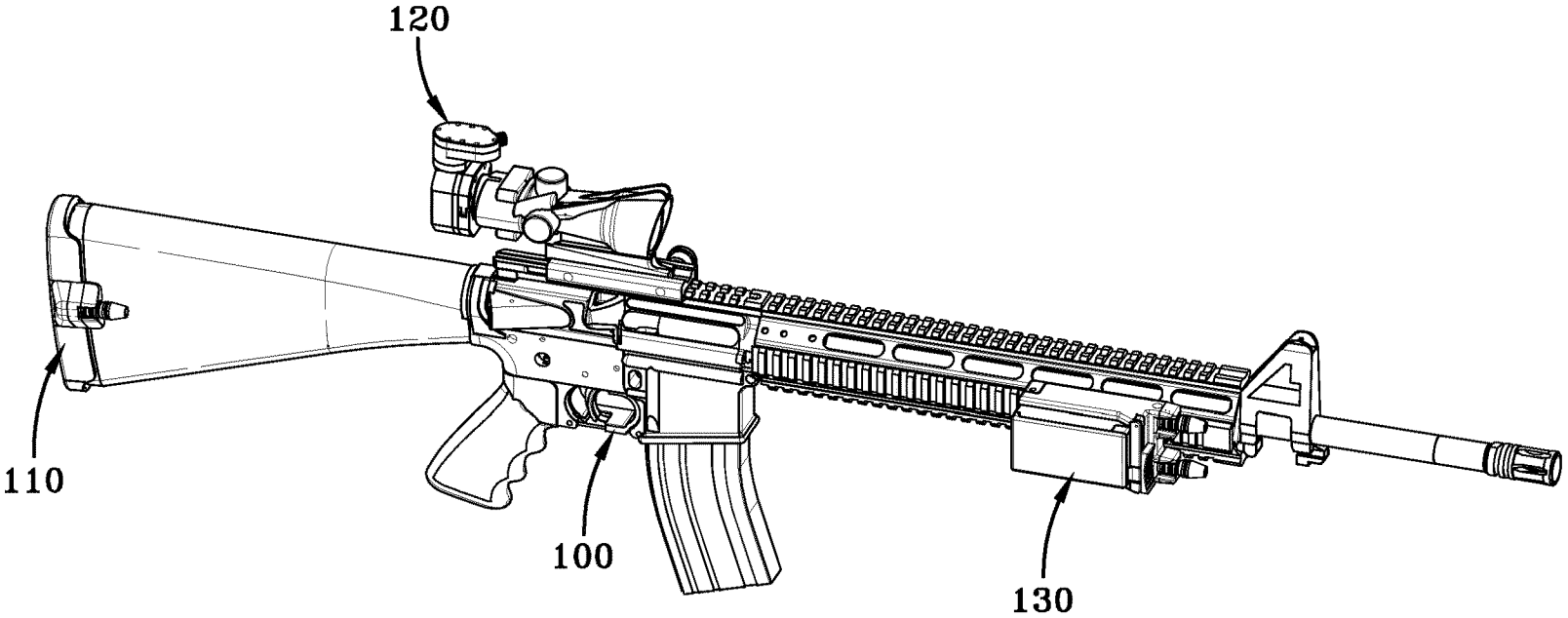
FIG. 1 is a perspective view of a MAT-MP system components mounted on a M16A4 weapon.

FIG. 1 is an exemplary embodiment of the installed components of the MAT-MP system. The components comprise a trigger pressure sensor (100), a buttstock pressure sensor (110), a high-definition combat optic camera (120) and a remote reconfigurable data collector (R2DC) (130).

Figure 2:
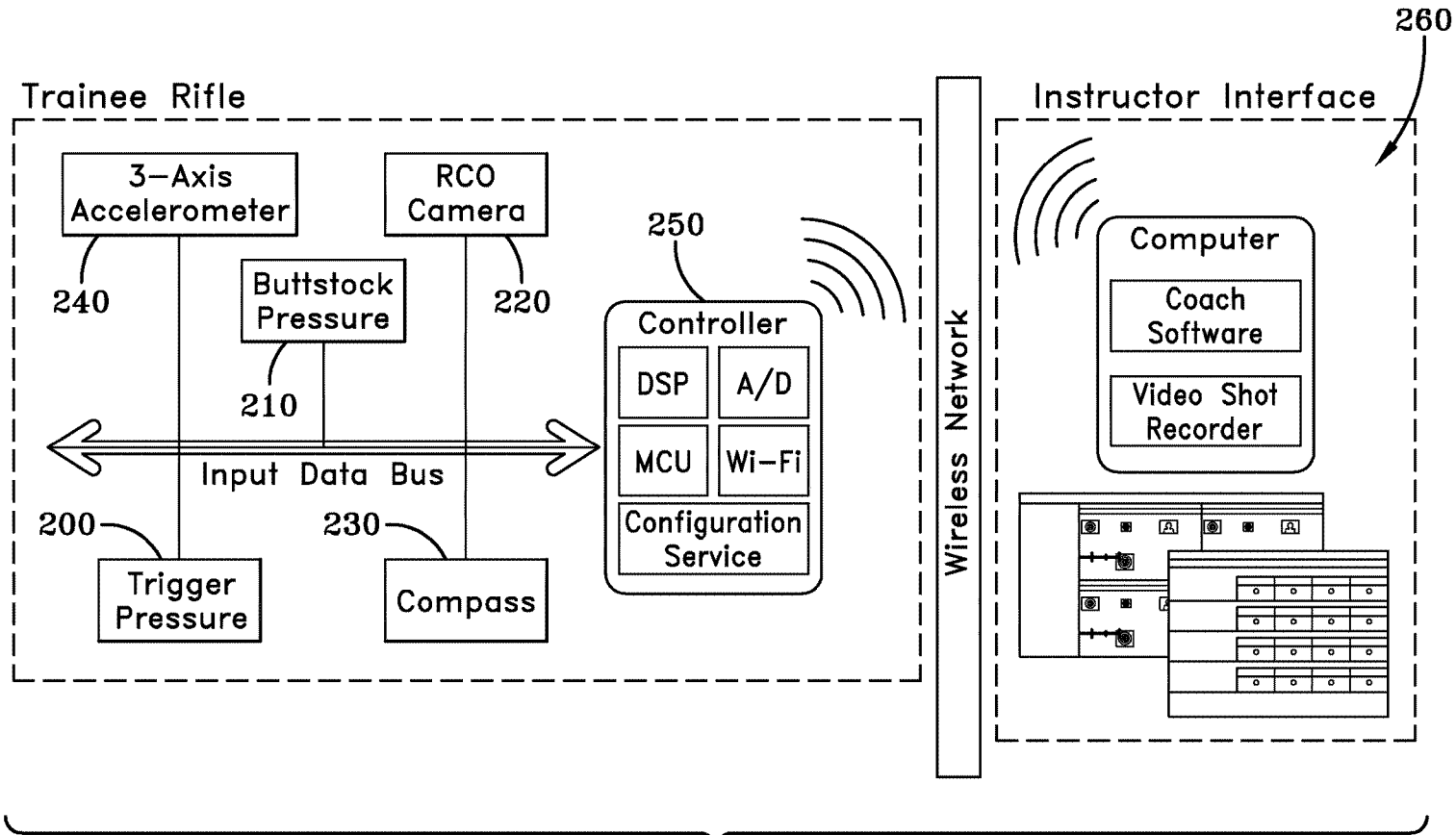
FIG. 2 is a conceptual drawing of the MAT-MP system functions and signal flow.

FIG. 2 is a conceptual drawing of the MAT-MP system function and signal flow. As shown in FIG. 1, the MAT-MP system components are connected to the trainee rifle and communicate with the instructor interface (260) through a wireless network. The trigger pressure sensor (200), the buttstock pressure sensor (210), the high-definition combat optic camera (220), a compass (230) and an accelerometer (240) are also shown. Any number of additional components that measure marksmanship proficiency, shooter performance, or weapon handling can be attached to the weapon within, the MAT-MP system. The reconfigurable data collector (R2DC) (250), which is also connected to the weapon, receives data from the marksmanship proficiency measuring components through one or more input data busses and sends it via a wireless network to the instructor interface. The instructor interface can be a laptop, tablet or the like. The R2DC (250) contains the circuitry to power the MAT-MP system components, receive and organize the data collected by the MAT-MP components and transmit this data, through a wireless network, to the instructor interface (260) that contains software to analyze and display the data. The cables connecting the components are not shown.

Figure 3:
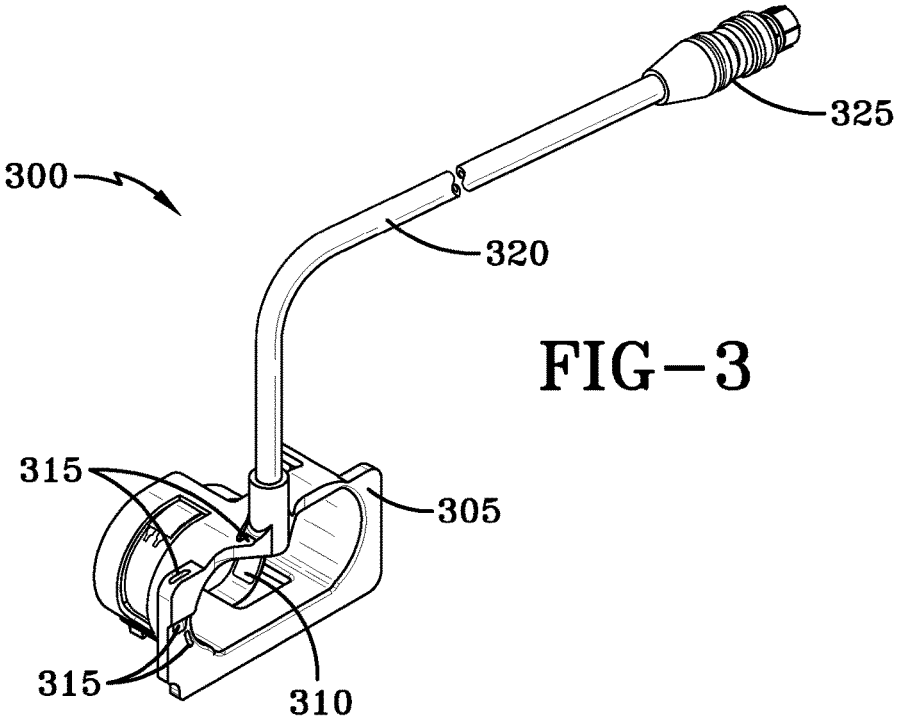
FIG. 3 is a perspective view of the left side of the assembled trigger pressure sensor.
Figure 3A:
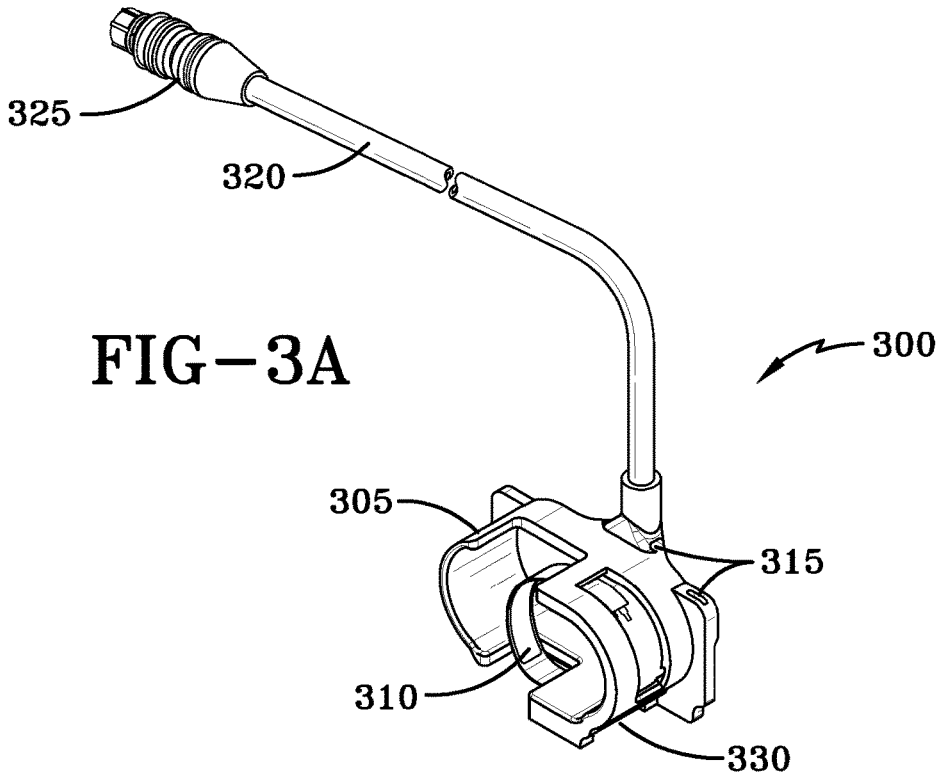
FIG. 3A is a perspective view of the right side of the assembled trigger pressure sensor.

Referring to FIGS. 3 and 3A, respective side views of the MAT-MP trigger pressure sensor are shown. The center piece of the trigger pressure sensor is the retainer (305), which is a molded piece designed to fit securely in the trigger well of a weapon. The retainer (305) of the current invention is contemplated to be a plastic material, but any number of polymers or other types of materials can be used. While a retainer can be molded to fit a variety of trigger wells, the retainer (305) of the exemplary invention is contemplated to fit the trigger well of an M16/M4. Because of its molded, secure fit in the weapon trigger well, the retainer (305) does not shift during firing, nor does it disturb the shooters feel and operation of the weapon in any other way.

The retainer (305) holds the trigger sensor element (310) aligned over the space the weapon's trigger will occupy while providing wiring channels (315) to bring the sensor element's output wires to the sensor cable (320) as well as a guide channel (330) to allow the sensor element's unattached and insensitive lower end to move and follow the trigger's motion during trigger pull. The trigger sensor connector (325) connects the trigger sensor element to the sensor's reading intelligence.

Figure 4:
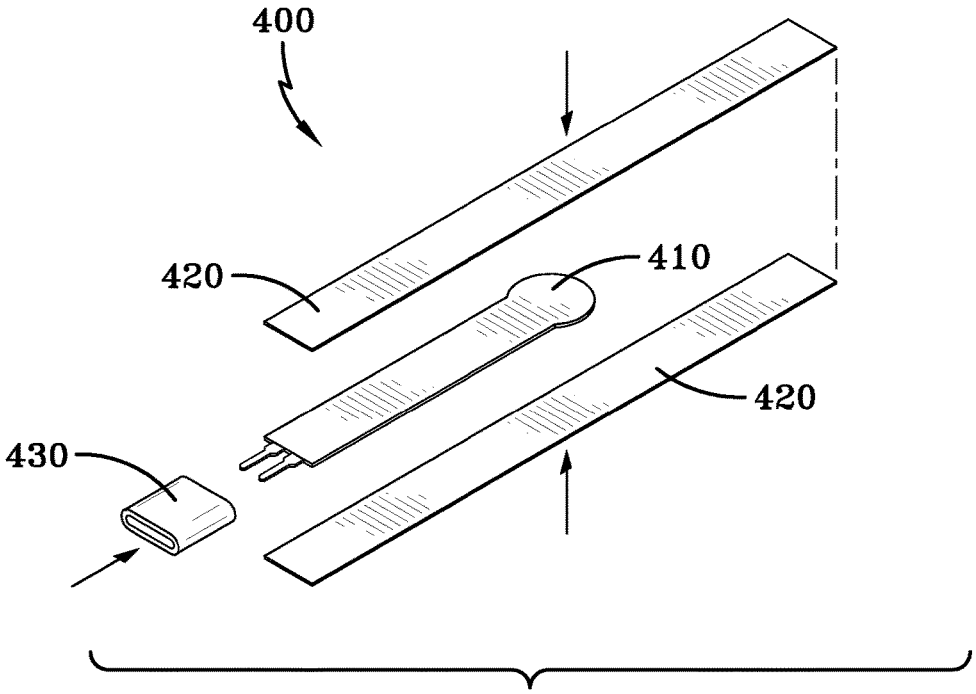
FIG. 4 is an expanded perspective view of the disassembled sensor components of the trigger pressure sensor.

FIG. 4 shows and expanded view of the individual parts of the trigger sensor element (400). The trigger sensor element (400) comprises four parts. The first part is a flexible force sensitive resistor (410). When the trigger sensor element (400) is constructed, this flexible force sensitive resistor (410) is sealed between two thin and flexible protective plastic sheets (420). The flexible force sensitive resistor (410) and the flexible protective plastics sheets (420) are held together by a small length of adhesive heat-shrink tubing (430). Alternatively, the heat-shrink tubing (430) can be replaced by a flexible adhesive or something similar.

In alternative embodiments of the invention, the force sensitive resistor (410) can be multi-channeled and divided into sensing zones, such that the force applied to different parts of the trigger via the trigger sensor element (400) can be determined simultaneously and independently. A force sensitive resistor (410) divided into horizontal zones would allow the system and the instructor to determine at what height on the trigger the shooter is applying pressure and provide remediation if this position was against instruction. A force sensitive resistor (410) divided into vertical zones would allow the system and the instructor to determine if the shooter is exhibiting trigger roll, i.e., a tendency to push in a direction other than straight back towards the weapon stock. A force sensitive resistor (410) divided into a grid of zones would allow the system and the instructor to determine both tendencies simultaneously.

In other alternative embodiments, the force sensitive resistor (420) can also be customized to more closely conform to the shape of the trigger of the weapon being tested. In these situations, the custom-made force sensitive resistor (420) will cover even more surface area of the trigger to give more trigger sensitivity data points for more nuanced marksmanship instruction.

Figure 4A:
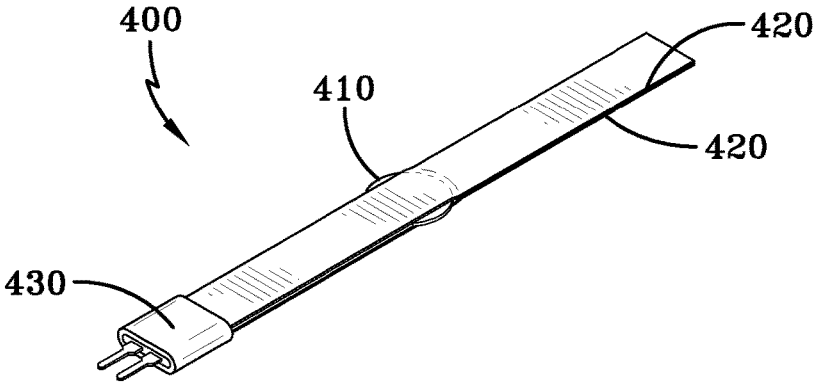
FIG. 4A is a perspective view of the assembled trigger pressure sensor element.

FIG. 4A shows a constructed trigger sensor element (400) with all the parts sealed and held together with heat-shrink tubing (430). In embodiments where the force sensitive resistor (420) is customized, the insensitive tail portion of the flexible protective sheets (420), are also incorporated into the shape of the force sensitive resistor and the trigger. This reduces the design and assembly complexity.

Figure 5:
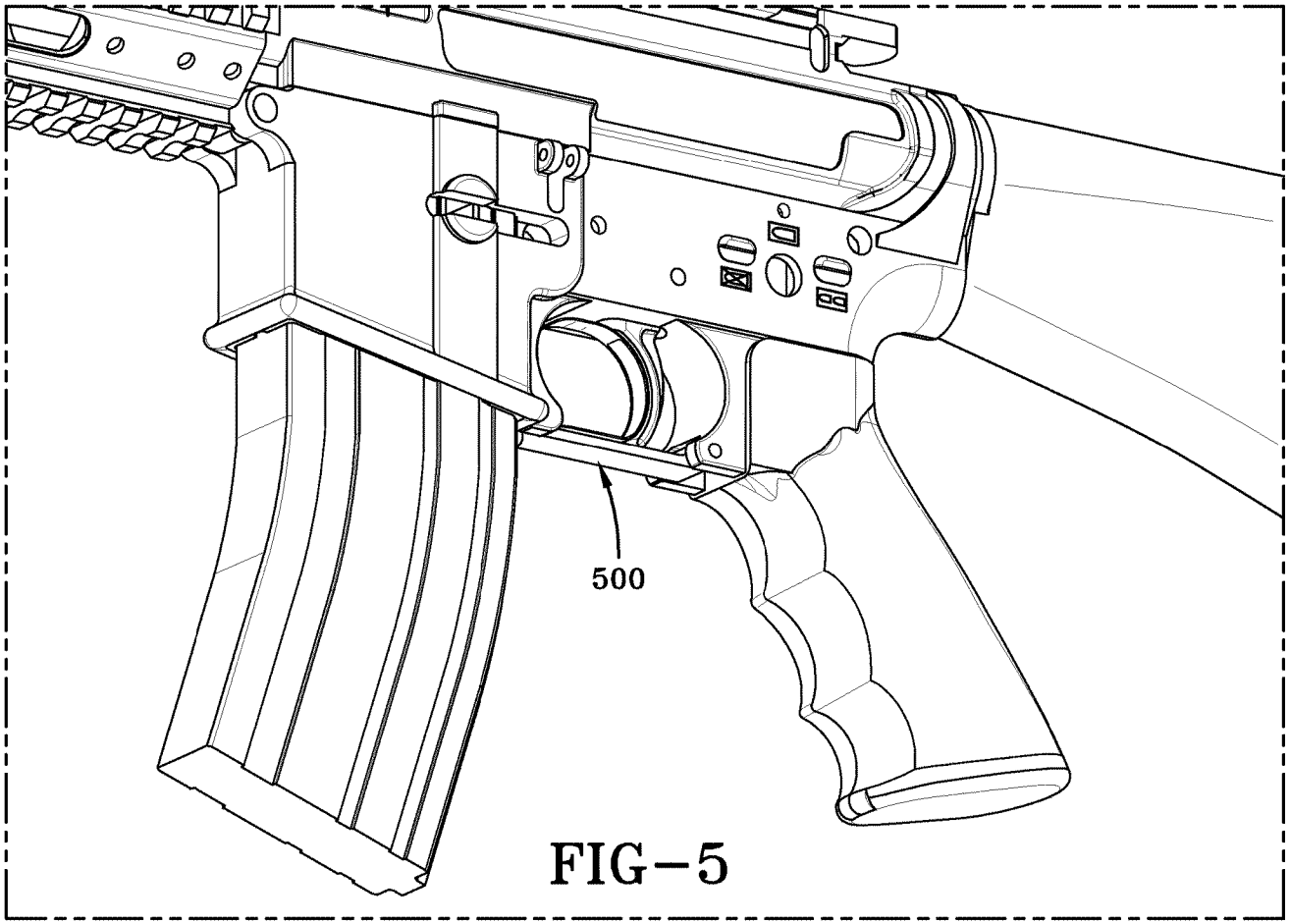
FIG. 5 is a perspective view of a typical M16/M4 weapon lower receiver prior to installation of the trigger pressure sensor.
Figure 5A:
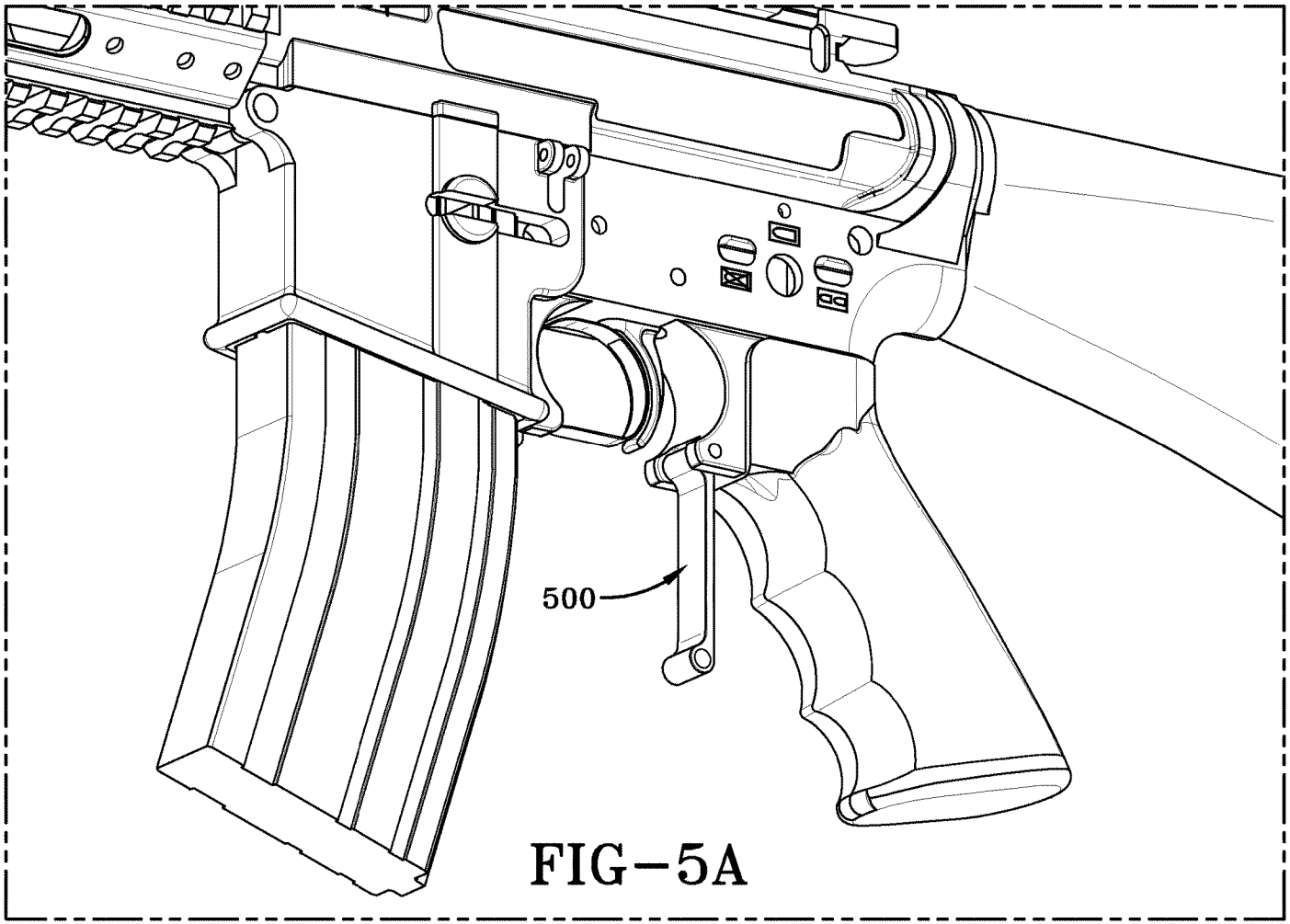
FIG. 5A is a perspective view of the M16/M4 weapon lower receiver prepared to accept the trigger pressure sensor.
Figure 6:
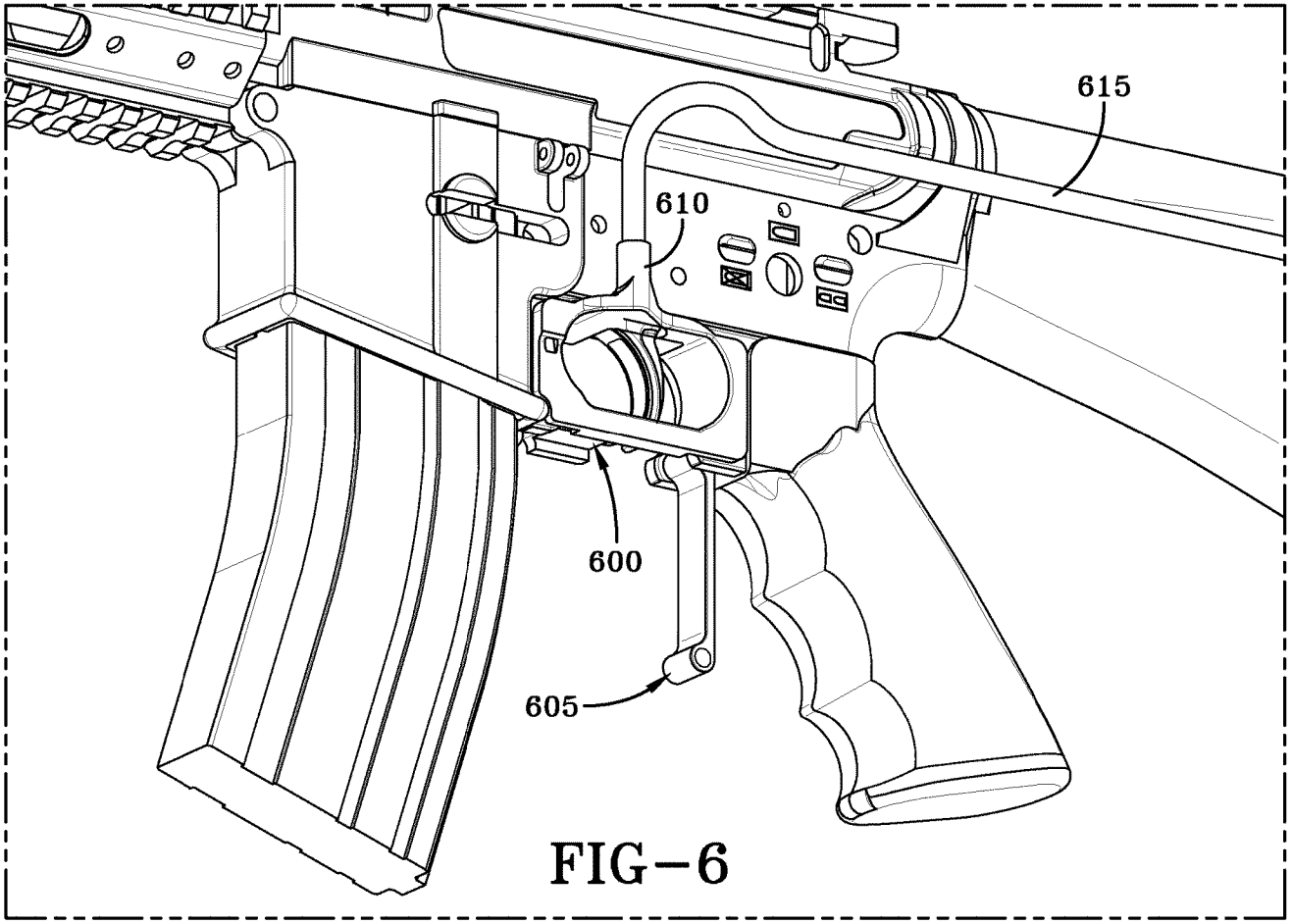
FIG. 6 is a perspective view of the lower receiver with the trigger pressure sensor installed.
Figure 6A:
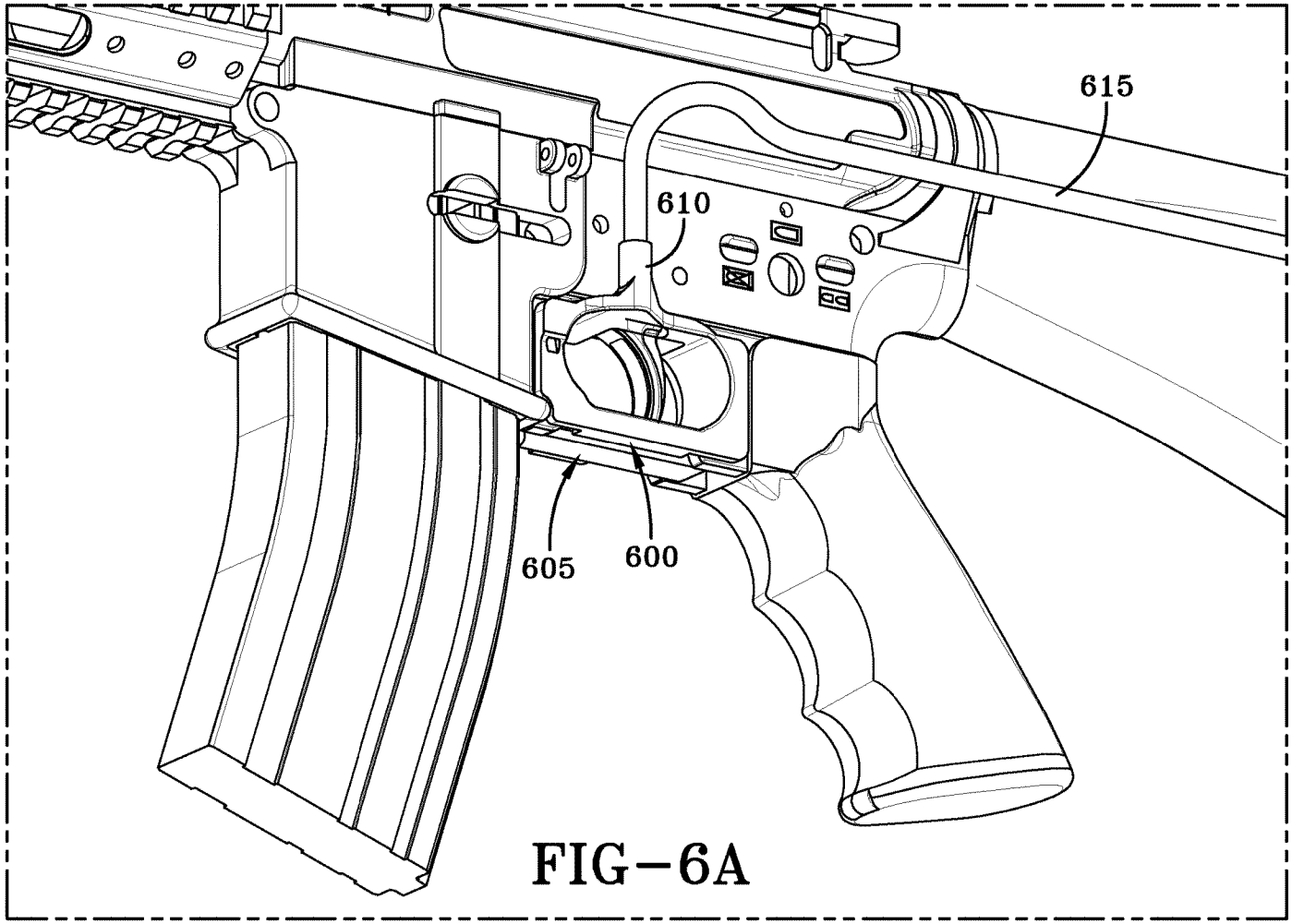
FIG. 6A is a perspective view of the lower receiver with the trigger pressure sensor installed and locked into place.

FIGS. 5, 5A, 6 and 6A show the trigger pressure sensor installation procedure. FIG. 5 shows a typical M16/M4 lower receiver with the weapon's integral pivoting trigger guard (500) still in place. The trigger guard (500) can be opened, as shown in FIG. 5A, with almost any available pointed instrument, such as a ball point pen or the nose of a bullet, by pressing on the forward ball detent which holds the trigger guard in place. FIG. 6 shows the trigger pressure sensor (600) inserted into the trigger well from the left hand side of the weapon so that the trigger sensor element (600) lays on the trigger. Returning the trigger guard (605) to its original locked position as shown in FIG. 6A secures the trigger pressure sensor (600) in place. The trigger sensor connector (610) can be connected to the sensor's reading intelligence with the trigger sensor cable (615), which is secured to the weapon as appropriate to complete the installation.

In alternate embodiments of the invention the multi-conductor trigger sensor cable (615) can be replaced with a ribbon cable or weapon-specific flexible flat cable (not shown) so that the sensor cable better conforms to the contours of the weapon and reduces the likelihood of interfering with the handling of the weapon. The cable can be eliminated altogether with a battery powered version of the trigger pressure sensor that transmits data wirelessly to a remote data collector.

Figure 7:
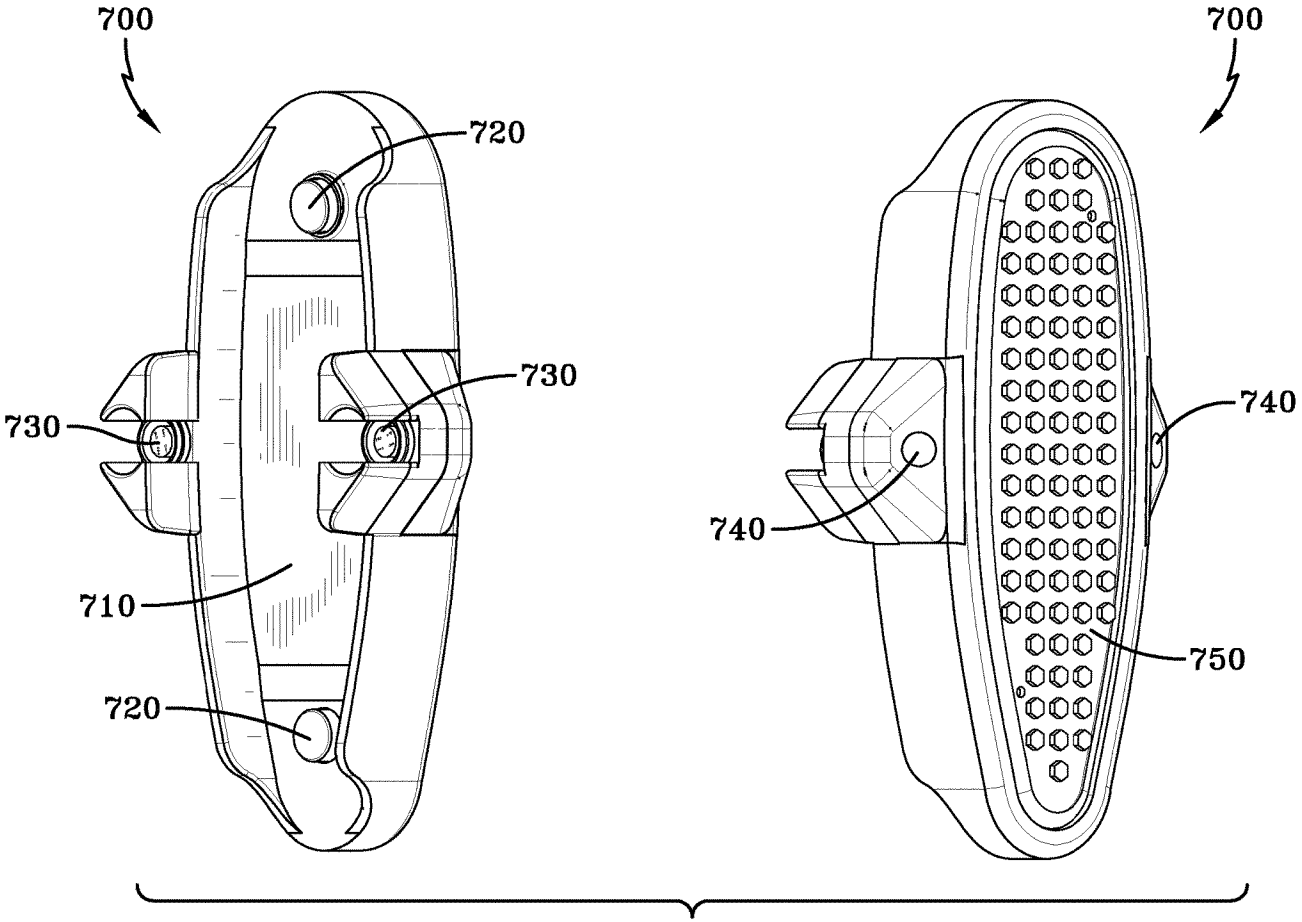
FIG. 7 is a perspective view of both the forward and rearward faces of the assembled buttstock pressure sensor

FIG. 7 is an exemplary embodiment of the MAT-MP buttstock pressure sensor (700). The buttstock sensor (700) comprises a body (710) that conforms to the shape of an M16A2-type fixed buttstock rear surface and houses the operative components of the invention. The buttstock body (710) can also be designed to fit other types of weapon buttstocks in alternative embodiments. In the current embodiment, the body (710) is contemplated to be a plastic material. However, any number of polymers, or other type of moldable materials, can also be used. Two rare-earth magnets (720) hold the assembly in place on the buttstock. The rare-earth magnets (720) can be replaced by other types of magnets, or any other connector that will allow the buttstock body (710) to be quickly attached and detached from the rear surface of the buttstock, while maintaining a secure connection that does not interfere with the operation or feel of the weapon. Two connectors (730) electrically connect the buttstock pressure sensor to the MAT-MP system. The connectors (730) are protected by connector covers (740). The connector covers (740) surround a majority of the perimeter of the connectors, while leaving space to allow access to the rear of the connectors and a removable rear cover plate (750).

Figure 8:
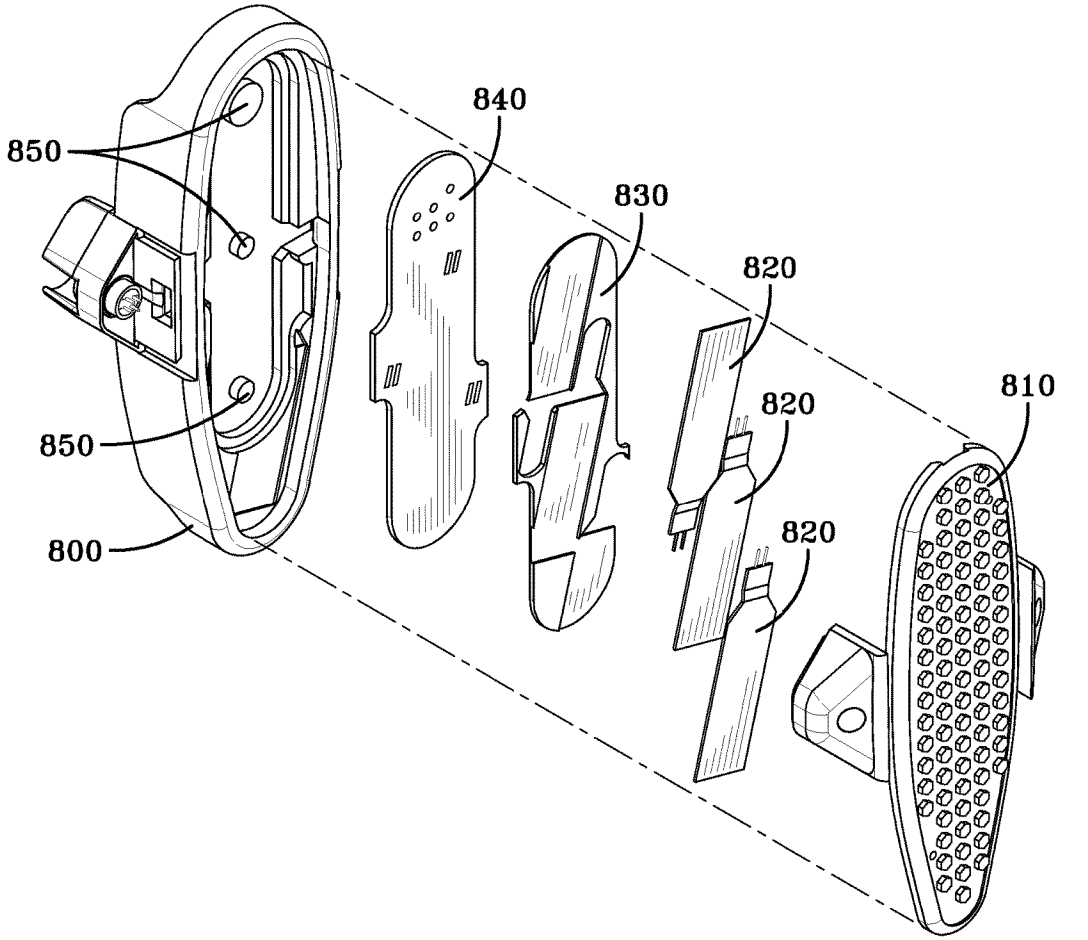
FIG. 8 is an expanded perspective view of the interior components of the buttstock pressure sensor.

FIG. 8 shows the internal components of an exemplary embodiment of the buttstock pressure sensor (800). Three force sensitive resistors (820) are used to detect pressure applied to the rear cover plate (810). In the current embodiment three force sensitive resistors (820) are contemplated. However, a smaller or larger number of resistors can be used based on the desired sensitivity. In alternative embodiments, the force sensitive resistors may have additional independently sensitive regions so that pressure on various parts of the face of the buttstock can be determined simultaneously and/or independently. For example, a buttstock pressure sensitive resistor with more horizontally-oriented regions of sensitivity would allow the system and the instructor to more accurately determine the vertical centroid of applied pressure and the distribution of pressure. This would give a more accurate determination of the position of the buttstock relative to the shooter's shoulder. Alternatively, the buttstock force sensitive resistors (820) can be divided into more vertically-oriented regions of sensitivity, which would allow the system and the instructor to more accurately determine the horizontal centroid of applied pressure and distribution of pressure to determine the angle at which the shooter was pulling the weapon into his/her shoulder. Moreover, the force sensitive resistors (820) can be divided into a grid of both vertically and horizontally-oriented regions of sensitivity, which would allow the system and the instructor to capture both of the above advantages simultaneously.

Also shown in FIG. 8 is a sensor platform (830), which is used to isolate and support the force sensitive sensors (820) above the circuit board (840). The sensor platform (830) in the current embodiment is made of plastic but other suitable materials can be used. The sensor platform (830) has a requisite number of slots to accommodate each force sensitive resistor (820). The slots orient the force sensitive resistors (820) in such a way as to isolate and prevent them from interfering with each other and from interfering with the circuit board (840), while maintaining a connection with the rear cover plate (810) to insure that pressure force measurements are captured.

The circuit board (840) hosts interface circuitry and the embedded intelligence required to perform pressure data collection, storage and transmission.

The rear cover plate (810) provides protection for the device's internal components while transmitting the forces applied to its outer face to the pressure sensors beneath. The rear cover plate (810) is flexible to ensure that the pressure sensors will only register pressure applied in the region generally above that sensor.

Finally, three bosses (850) on the inner face of the rear cover plate over the force sensitive resistors ensure good contact with the sensitive regions of the sensors. The three bosses (850) on the body (800) support the circuit board (840) to prevent applied pressure from flexing and damaging the circuit board (840), as well as provide a firm platform beneath the force sensitive resistors (820) to ensure consistent and reliable pressure readings.

Figure 9:
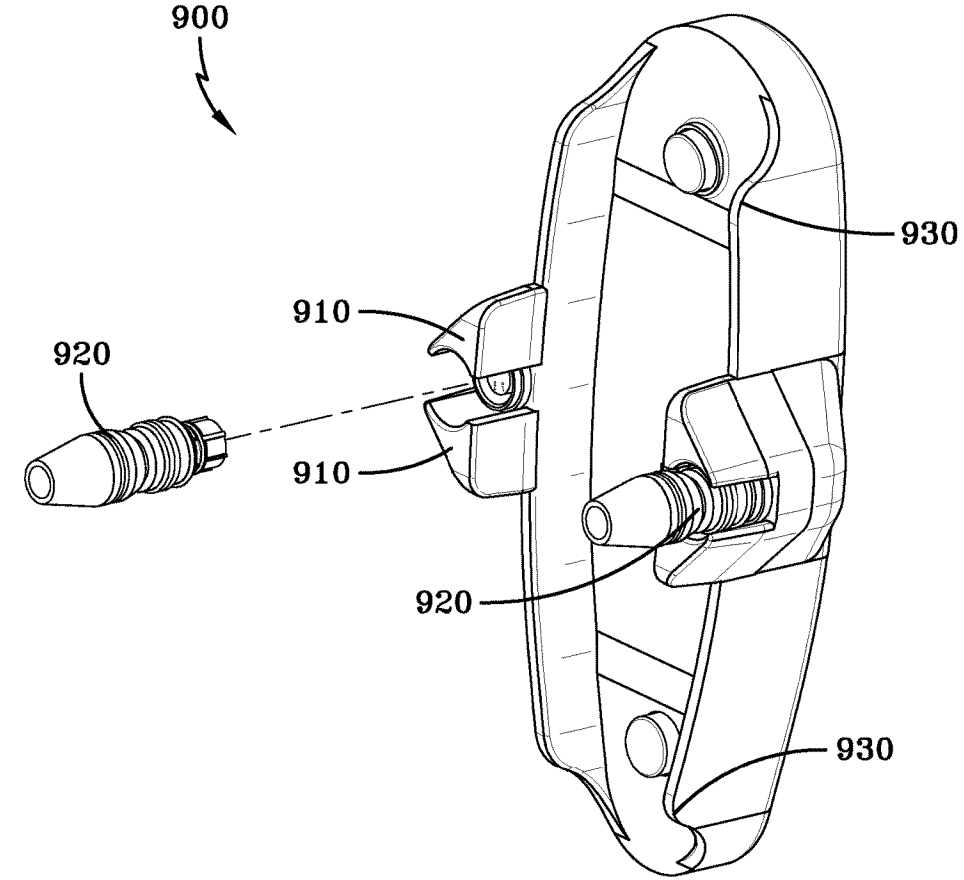
FIG. 9 is a perspective view of the assembled buttstock pressure sensor with electrical components.

FIG. 9 illustrates the novel protective and ergonomic design features on the inner surface of the buttstock body (900). The electrical connectors (940) are protected from inadvertent impacts and damaging lateral stresses during weapon handling or firing by two protective flanges (910). The protective flanges (910) cover a majority of the perimeter of the connectors (940), while providing openings (920) about the width of a finger to allow access to the connector (940). This prevents accidental removal during weapon handling. Two cutouts (930) are also provided in the upper and lower extremities of the body (900) to remove areas of the body (900) that would otherwise absorb large flexural stresses and potentially damage the body (900) during the shock of weapon fire.

Figure 10:
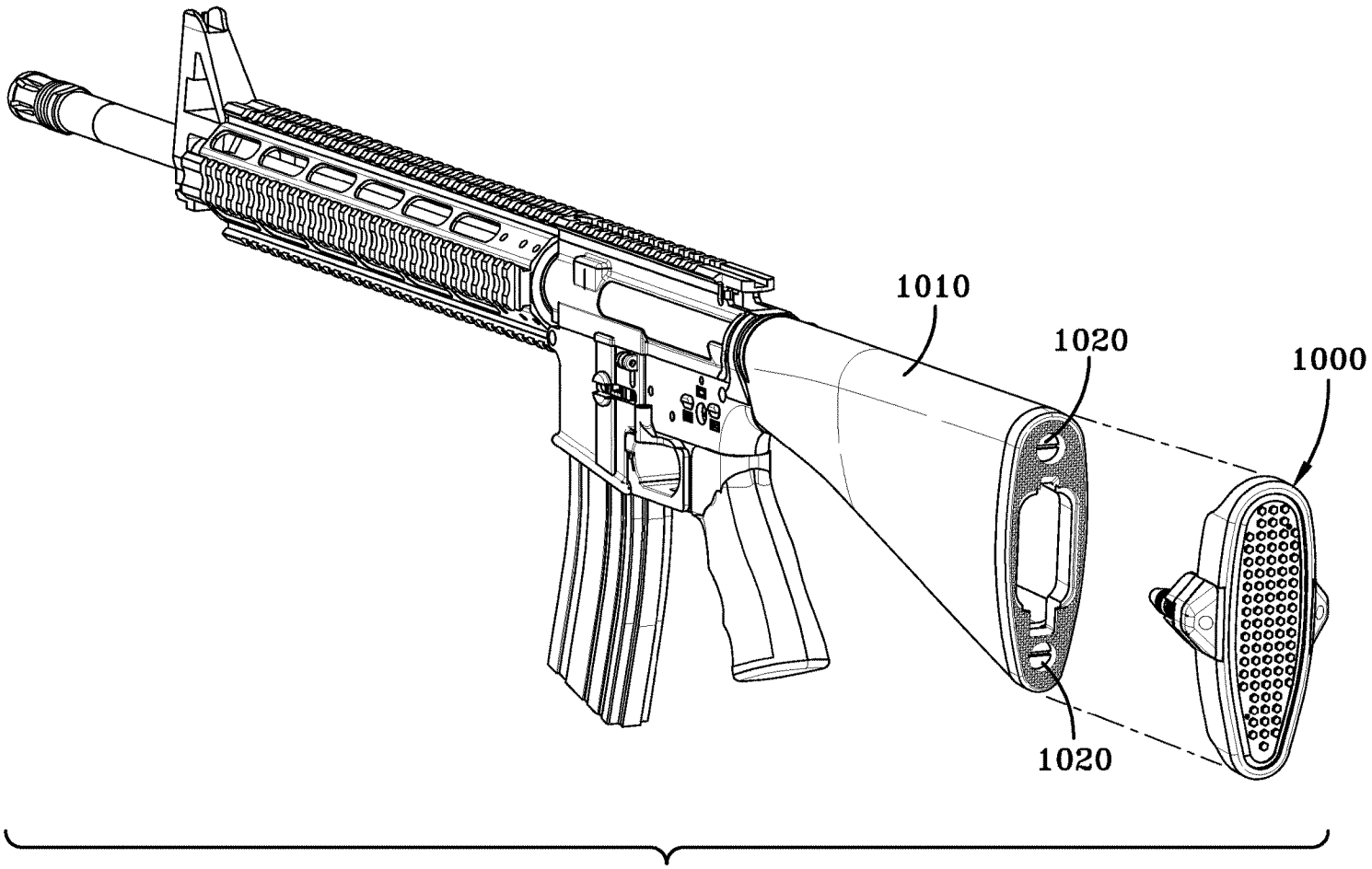
FIG. 10 is a perspective view of the installation of the buttstock pressure sensor on a M16A2-type weapon with a fixed buttstock.

FIG. 10 shows an exemplary embodiment of the buttstock pressure sensor (1000) installed on a M16A2-type fixed buttstock (1010) by fitting it to the rear surface of the buttstock (1010). Once in place the two rare-earth magnets (not shown) installed on the forward face of the sensor assembly will magnetically engage the buttstock's mounting screws (1020) and hold the sensor assembly securely in place during normal weapon handling. Other types of magnets and devices can be used to secure the buttstock body (1000) to the weapon buttstock (1010) in alternate embodiments. For example, in an alternate embodiment, snap fit tabs could click over the edges of the flanged rear surface of many adjustable buttstocks.

Installation is completed by connecting the electrical connectors to interface the buttstock pressure sensor to the other MAT-MP system components.

In alternate embodiments, the buttstock pressure sensor system can also measure a variety of other variables that effect marksmanship. Sensors, can be included that measure the canting of the weapon. Gravity-sensing accelerometers that monitor the attitude of the weapon can also be included. In addition, high-performance tracking sensors, such as six degree-of-freedom inertial tracking sensors, can be implemented to allow the MAT-MP system to monitor the orientation and location of the weapon. The data may be transmitting using wired serial communication protocols, allowing faster data transmission and sensor update rates.

Figure 11:
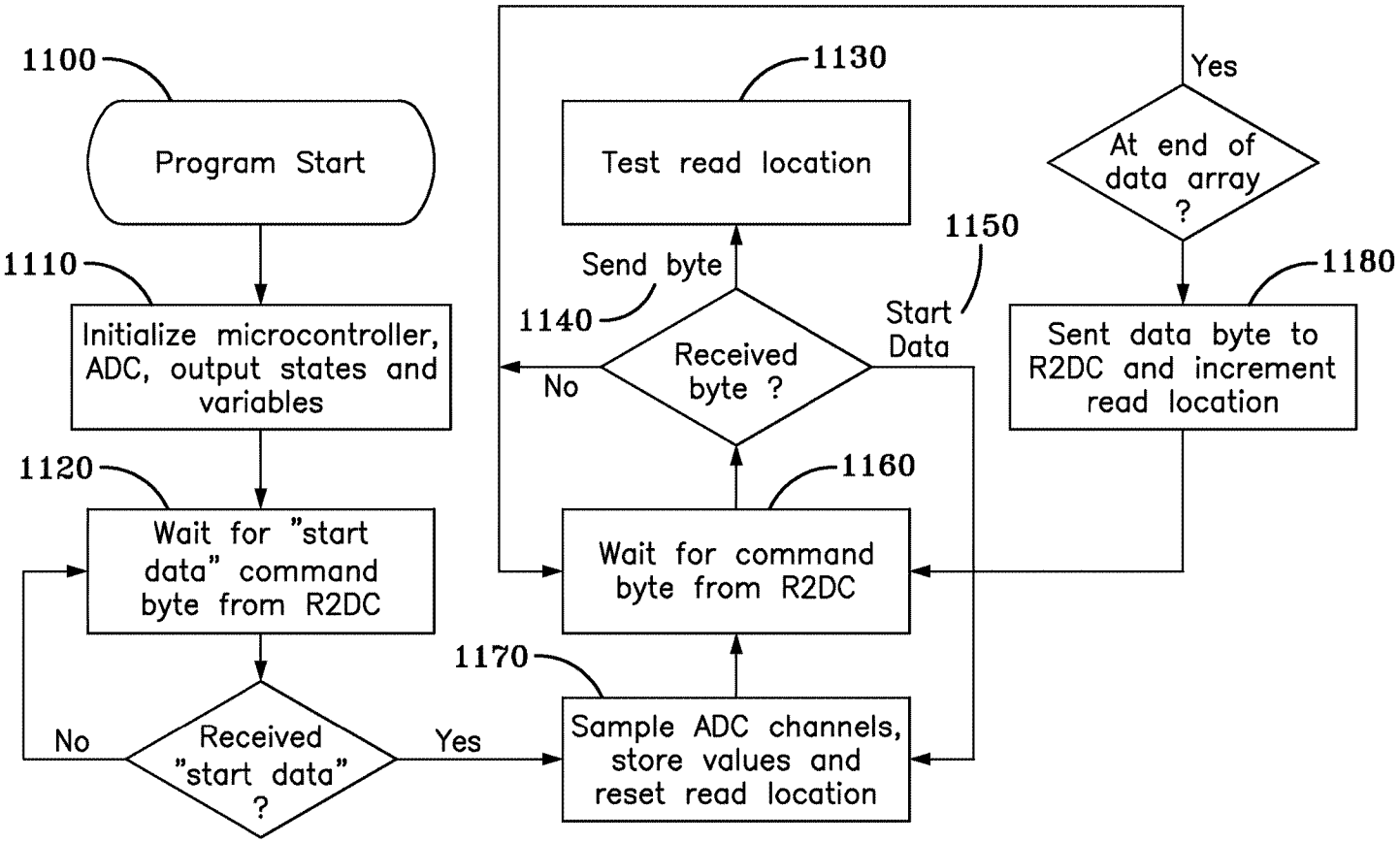
FIG. 11 is a flowchart capturing the operation of an embodiment of firmware running on the buttstock sensor embedded microcontroller.

FIG. 11, shows an embodiment of the intelligence required to read, store and transmit the sensor data collected by the buttstock sensors. The intelligence is provided by firmware running on a microcontroller onboard the printed circuit board (see (840) in FIG. 8) Referring to FIG. 11, after the program starts (1100), the microcontroller initializes its required clocks, timers, general purpose I/O, register values and the separate onboard multi-channel analog-to-digital converter (ADC) (1110). The microcontroller then waits for a "start data" command to be received from the R2DC through a serial communication connection (1120). In the exemplary invention the I2C serial protocol is used for serial communications between the buttstock pressure sensor and the R2DC, although the disclosed functions could be performed through any serial protocol in alternate embodiments. The microcontroller will then sample the available ADC channels, store the values in a twelve byte data array and reset the read location to the beginning of the data array (1170). The data structure of the disclosed invention allows for ADCs of up to 16-bit accuracy to be used, although alternate embodiments of the invention may use higher accuracy ADCs. Three ADC channels are used to read the three buttstock pressure sensor force sensitive resistors while three are available to read externally connected sensors. In the exemplary invention, the MAT-MP trigger pressure sensor value is read and stored by the buttstock pressure sensor microcontroller through one of these external ADC channels and the remaining two channels are unused. The microcontroller will then wait for another command byte from the R2DC (1160). A received 'send byte' command (1140) will cause the microcontroller to test the current read location (1130). If the read location has exceeded the data array size, i.e., twelve bytes of data have already been sent, the microcontroller will ignore the 'send byte' command and wait for another command byte (1160). If the read location is within the bounds of the data array, i.e., less than twelve bytes of data have been sent, the microcontroller will send the byte of data at the current read location to the R2DC and increment the read location (1180) before returning to the command byte wait loop (1160). A total of twelve 'send byte' cycles are required to send all six ADC channel two-byte values. A 'start data' command received at any time (1150) will cause the microcontroller to restart the data sequence by capturing and storing a new set of sensor values and resetting the read location to restart the data sequence.

Figure 12:
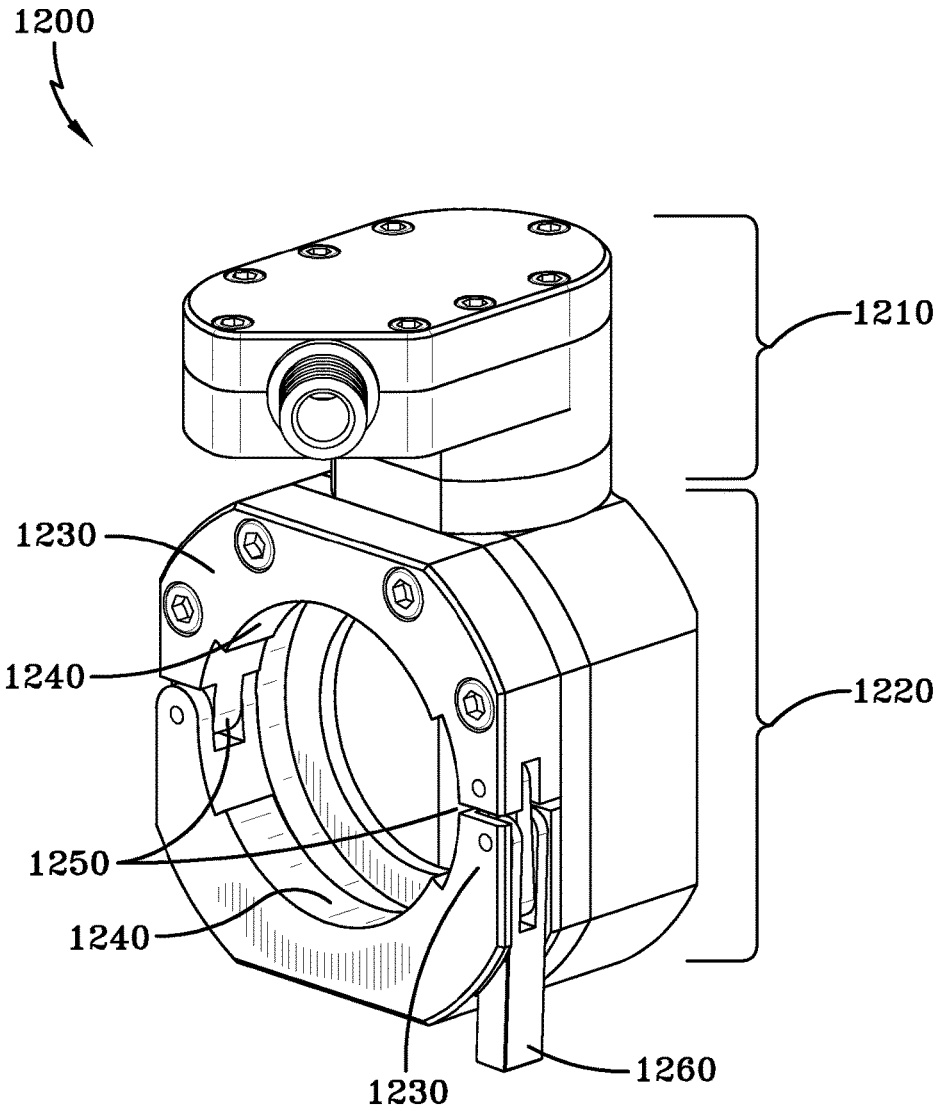
FIG. 12 is a perspective view of the MAT-MP high definition combat optic camera assembly.

FIG. 12 shows an embodiment of the MAT-MP High Definition Combat Optic Camera (1200). The optic camera (1200) comprises a camera circuit board and focusing lens housing (1210), a beam splitter main body housing (1220), and a double hinged clamping mechanism (1230) that is made to mate to the rear objective housing of an Advanced Combat Optic Gun sight (ACOG). The inside surface area (1240) of the clamping mount (1230) is recessed and lined with semi-compressible rubber pads. Alignment keys (1250) assist in obtaining proper rotational alignment of the camera device when mounting to the combat optic. The alignment keys (1250) in the exemplary embodiment of the invention are specifically made and located to mate to body surfaces, particularly to the ubiquitous ACOG. However, alignment keys (1250) can be adapted to work with any type of optic device. The clamp actuation lever (1260) opens, closes, and latches the bottom portion of the hinged clamp as the lever moves through an arc of motion equal to approximately one hundred degrees.

Figure 13:
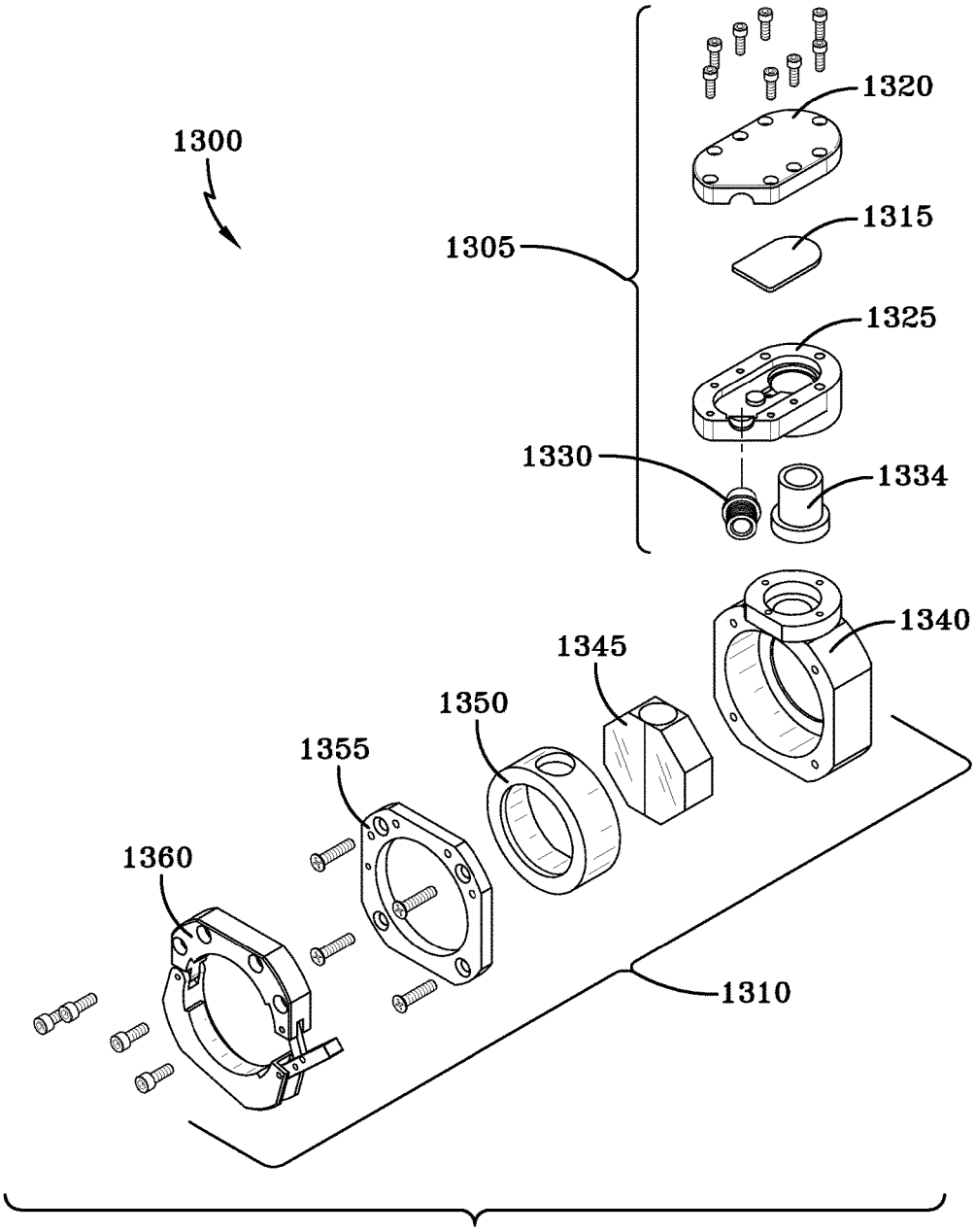
FIG. 13 is an expanded perspective view of the MAT-MP high definition combat optic camera assembly.

FIG. 13 shows the components of the camera circuit board and focusing lens housing (1305) and the beam splitter main body housing (1310). The camera circuit board and focusing lens housing (1305) of the current invention is comprised of five parts. A printed circuit board with high definition Complementary metal-oxide-semiconductor (CMOS) camera of form factor 1/2.5" (1315) is mounted inside a housing including a top circuit board cover (1320) and a bottom circuit board and lens holder (1325). A cable grommet and strain relief (1330) provides weather tight power and data cable access to the circuit board. A focusing lens (1334) of focal length and diameter specifically matched to the chosen CMOS sensor is mounted in the lens holder (1325) that provides for final adjustment of the focusing lens during component assembly.

The beam splitter main body housing (1310) of the exemplary embodiment of the current invention is comprised of four parts: A main body base (1340), a beam splitter (1345), a beam splitter housing (1350), and an interface mount (1355). The main body base (1340) includes a light path opening diameter of at least 1.10." This size opening was chosen as an optimal size that would not interfere with the shooter's ability to achieve proper sight picture. However, other opening sizes could also work with the invention. The beam splitter housing (1310) includes the beam splitter (1345). The beam splitter (1345) of the exemplary embodiment has a surface width greater than 8 mm and a 50/50 reflection/transmission ratio. However, in alternative embodiments, other beam splitter widths and reflection/transmission ratios can be used or customized. The beam splitter (1345) is held within the beam splitter body housing (1310) and the light path opening that is aligned with the focusing lens (1334). The assembled beam splitter housing (1350) containing the beam splitter (1345) is mounted inside the main body base (1340) and is held in place by the interface mount (1355) and the clamping mount (1360).

Figure 14:
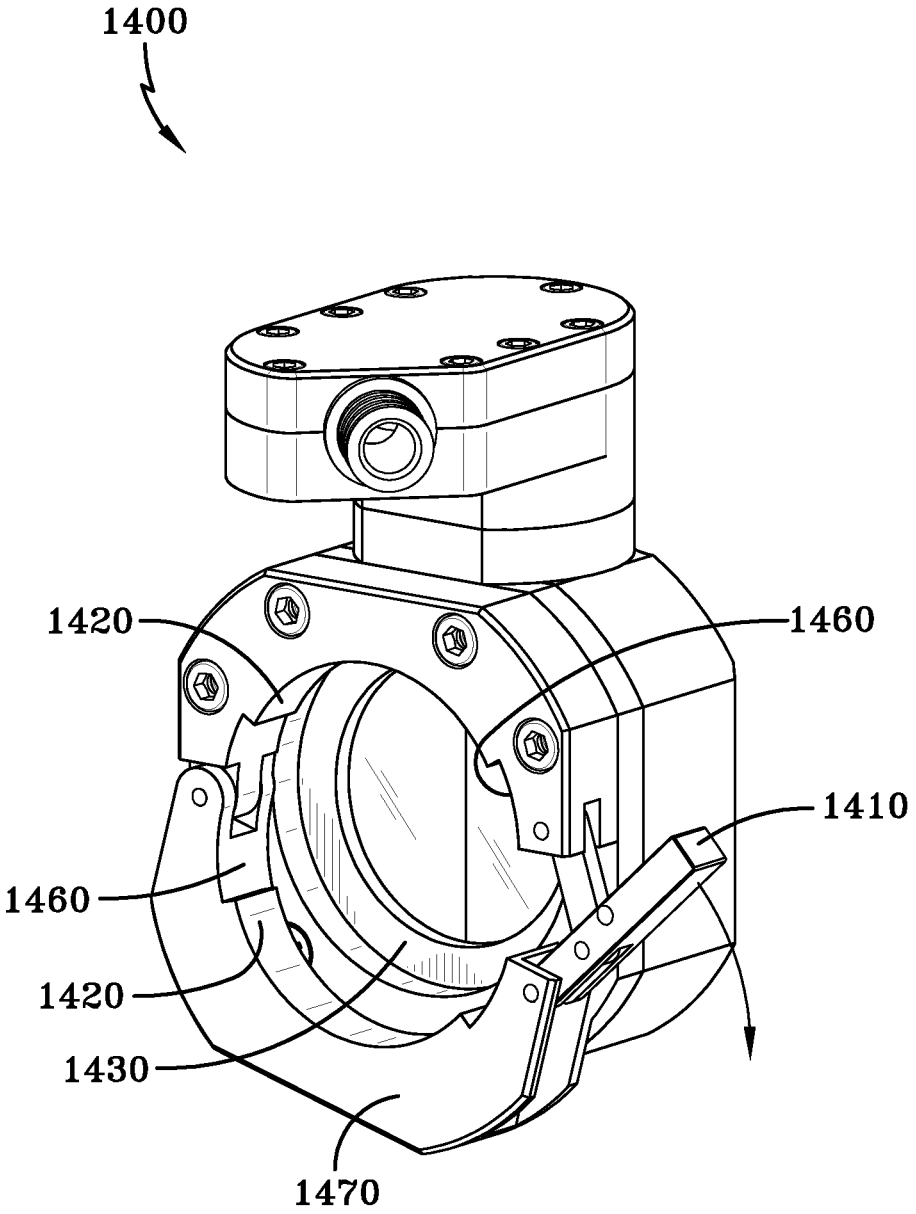
FIG. 14 is a perspective view of the MAT-MP high definition combat optic camera assembly with the clamping mechanism in the open position.
Figure 14A:
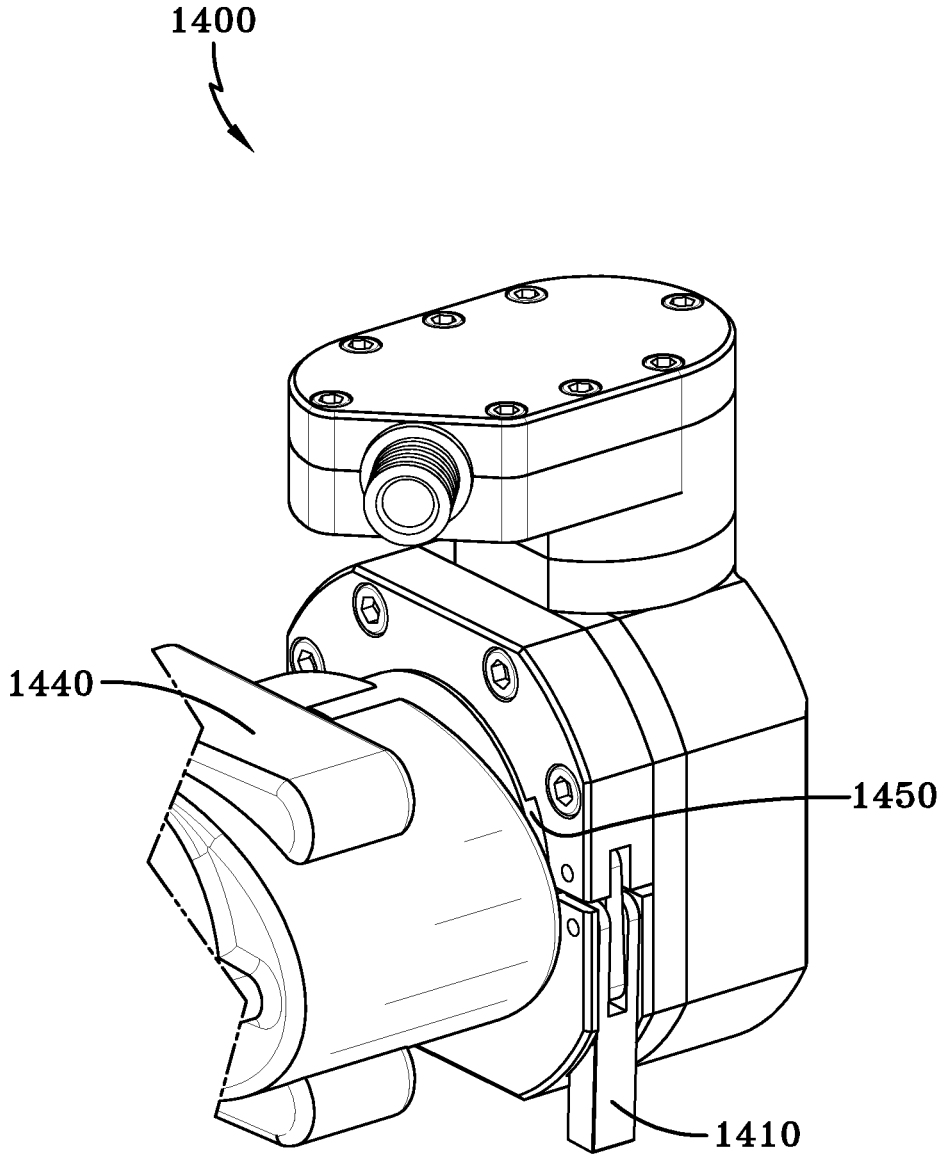
FIG. 14A is a perspective view of the MAT-MP high definition combat optic camera assembly mated to the rear objective housing of an advance combat optic gun sight.

Referring to FIGS. 14 and 14A, the mounting procedure for the camera assembly (1400) is shown. The clamp actuation lever (1410) is rotated downwards to its maximum extent dropping the lower hinge face of the double hinged clamping mechanism (1470) to its lowest extent and the assembly (1400) is placed over the rear objective housing of the combat optic (1440) such that the upper fixed section of the clamping mechanism (1470) is in contact with the upper portion of the combat optic (1440). The camera assembly (1400) is pushed forward until the face of the combat optic (1440) is flush with the front surface of the beam splitter enclosure (1430). The actuation lever (1410) is rotated downward through its arc of motion pulling the lower portion of the clamping mechanism (1470) up. As the clamping mechanism (1470) moves upward, the alignment keys (1460) will engage on the alignment features (1450) of the combat optic (1440). At the same time the semi-compressible rubber pads (1420) will begin to engage the circumference of the combat optic housing (1440). Continuing through the actuation lever's (1410) upward motion, the pads (1420) will begin to differentially compress forcing the camera assembly (1400) to center itself on the circumference of the combat optic housing (1440), while the alignment keys (1460) will maintain the camera assembly (1400) in the correct rotational alignment. The actuation lever (1410) when reaching its maximum upward travel will seat flush to the wall of the clamping mechanism at an angle of approximately negative five degrees to the vertical thus latching the clamping mechanism (1470). The camera assembly cable (1400) is connected to the R2DC's camera input port and the camera cable is secured to the weapon as appropriate to complete the installation.

FIG. 15 shows two views of an embodiment of the remote reconfigurable data collector (R2DC). The R2DC includes a main body (1500) and a battery back (1505).

The R2DC battery pack (1505) has two LED status indicators (1510). The battery pack (1505) is held in its place on the main body (1500) by the battery retention slide (1515). The main body (1500) hosts two connectors (1520), one for a camera and one for a sensor bus. However, in alternative embodiments additional connectors (1520) can be hosted. The additional connectors would be dedicated to either a sensor bus or a camera input. Multiple sensored devices may be connected to each sensor bus. For example, an accelerometer, a compass and other types of optics have been contemplated to work with the MAT-MP system of the current invention.

The purpose of the connectors is indicated by markers (1530) to ease identification and installation. The marker used on the embodiment shown in FIG. 15 designates a camera. In other embodiments, a color convention system is contemplated to denote the various devices connected to the MAT-MP system. In the general case, more than one sensor bus port can be provided on the main body to provide for greater flexibility of sensor selection and connection. When installed, the camera and sensor bus cable connectors (1520) are protected from inadvertent impacts and damaging lateral stresses by protective flanges (1525). Access to the connectors (1520) is achieved through openings in the protective flanges (1525) that are about the width of a finger, preventing accidental removal during weapon handling. A mounting boss (1540) provides a keyed platform and two threaded holes to attach a weapon mount appropriate to the weapon and location on the weapon that the R2DC is to be installed.

The R2DC main body (1500) also provides an LED status indicator (1550) for monitoring device state and a utility button (1560) for accessing initialization and test functions. An embossed ID number (1570) is present on both sides of the unit for device identification.

FIG. 15A shows the R2DC main body (1500) and R2DC battery pack (1505) separated. The battery pack (1505) is installed by first moving the battery retention slide (1515) to the "unlocked" detent position. The battery pack (1505) is then installed on the main body (1500) by sliding the battery pack alignment rails (1580) into the main body alignment guides (1585) and pushing the battery pack (1505) toward the battery retention slide (1515) until the spring-loaded main body battery contacts (1540) engage the battery contact pads (not shown). The battery pack retention tang (1590) will now be aligned with the battery retention slide channel (not shown). Moving the battery retention slide (1515) to the opposite "locked" detent position (shown) will lock the battery pack (1505) in place.

FIG. 16 presents two views of the R2DC main body cover (1600). The cover is installed on the main body (see FIG. 15) by sliding the cover mounting guides (1605) onto the matching mounting channels on the top lip of the main body. The cover mounting tab (1610) provides a strong and positive connection between the cover (1600) and main body. The cover (1600) is held in place by installing the cover pin (1615) through the cover pin bushings (1620). The cover mounts a spring-loaded ball detent (1625) that falls into one of the cover pin alignment grooves (1630) when the pin is fully inserted, preventing the pin (1615) from coming out during weapon fire. The mounting boss (1635) is part of the main body cover (1600). An internal metal reinforcement bar provides two threaded holes (1640) for securing a weapon mount to the cover.

Referring to FIG. 17, the internal components of the R2DC main body are shown. The R2DC main body comprises: a main circuit board (1700) which hosts the required power conditioning and sensor interface circuitry; a microcontroller (1710) that provides the embedded intelligence required to gather, store and wirelessly transmit sensor and video data an aluminum heat sink (1720) to dissipate the microcontroller's heat of operation as well as secure the main circuit board in place; and a wireless antenna (1730). In the exemplary embodiment of the invention the wireless antenna (1730) is a 2.4 GHz flexible printed circuit board antenna.

The R2DC powers the attached sensor and camera devices. The R2DC drives, scales and/or filters, as required, the output of the attached analog sensors. It also polls, monitors and stores the analog and digital sensor values with the embedded intelligence. Moreover, the R2DC captures high-definition video from the attached combat optic camera, and powers, monitors and controls any attached trainee feedback devices.

FIG. 18 shows an exploded view of the R2DC main body spring-loaded battery contact assemblies. The R2DC has two battery contacts: battery pack positive voltage and battery pack negative voltage. Each of the two contact assemblies comprises: a main body bushing (1800) to provide reinforcement of the plastic main body and ensure smooth motion of the contact; a battery contact body (1810) to engage the battery pack contact pads; a wave spring (1820) to provide contact motion and force; and a battery wiring tab (1830) to provide a wiring point to deliver power to the main circuit board. The battery contact assemblies are secured in place and held under tension by the battery contact cap (1840).

Referring to FIGS. 19 and 19A, battery pack retention on the R2DC main body is provided by the battery retention slide (1900). The slide (1900) is installed in the R2DC main body battery retention slide channel (1910) and held in the channel (1910) by the battery retention slide block (1915). The slide block is itself held in place by the battery retention slide block pin (1920). A spring-loaded ball detent (1930) engages with indentations (1940) on the back of the battery retention slide (1900) to provide two distinct slide detent positions, "unlocked" and "locked." The unlocked position completely disengages the slide (1900) from the battery pack's retention tang (not shown) while the locked position completely engages the tang, locking the battery in place.

FIGS. 20A and 20B show open and closed versions of a MAT-MP barrel-clamp mount (2000) for securing the R2DC to a weapon. The MAT-MP barrel-clamp is meant to be attached to the barrel of a small arms weapon, allowing the R2DC to hang beneath the barrel and the shooter's line-of-sight. The barrel-clamp mount (2000) is installed by opening the mount and passing it over the weapon's barrel. As shown in FIG. 20A, the barrel strap (2010) is rotated over the weapon barrel and the barrel clamp nut (2020) is rotated to capture the strap (2010) and secure to the mount to the weapon. The mount's alignment tabs (2030) are used to engage the weapon's bayonet lug to ensure the mount is directly beneath the barrel. The clamp nut (2020) is then tightened to secure the mount to the weapon barrel. Commercially available mounts can also be used to secure the R2DC to the barrel of the weapon.

The R2DC may also be easily installed on any weapon and in any location equipped with Picatinny rails by installing a commercially-available Picatinny rail mount on the R2DC as shown in FIG. 21. The mount can be installed on the R2DC main body by placing the mount over the main body mounting boss (2110) and installing screws (2140) through holes on the mount (2130) and into threaded holes (2120) on the mounting boss (2110)

FIG. 22 shows embodiments of two mounting locations for the R2DC on an M16A4.2200A shows the R2DC provided with a barrel clamp to mount to the weapon's barrel while 2200B shows the R2DC with a Picatinny rail mount attached to the weapon's Picatinny rail.

Although the invention has been described in detail with particular reference to these preferred embodiments, other embodiments can achieve the same results. Variations and modifications of the present invention will be obvious to those skilled in the art and it is the intent of this application to cover, in the appended claims, all such modification and equivalents. The entire disclosure and all references, applications, patents and publications cited above are hereby incorporated by reference.

What is claimed is:

1. A system for monitoring weapon marksmanship proficiency on a weapon with a weapon buttstock and a weapon barrel, the system comprising:

a weapon trigger mounted trigger pressure sensor for sensing pressure on a weapon trigger of the weapon, wherein the weapon trigger mounted trigger pressure sensor comprises:

a retainer, with a top half and a bottom half, that fits securely into a weapon trigger well;

a trigger pressure sensor, with a head end and a tail end, wherein the head end is secured to an inner surface of the top half of the retainer and the tail end sets flush against the weapon trigger; and a sensor cable with a head end and a tail end, wherein the head end of the sensor cable is secured to the top half of the retainer to electronically receive trigger pressure sensor measurements and the tail end of the sensor cable electronically transmits the trigger pressure sensor measurements to an electronic analysis device;

a weapon buttstock end mounted buttstock pressure sensor, the weapon buttstock having a weapon buttstock end, the weapon buttstock end mounted buttstock pressure sensor disposed at the buttstock end;

a weapon optic mounted camera for capturing video evidence of a shooter's sight alignment, sight picture and aim point;

a remote data management and processing application running on a computer system; and a reconfigurable data collector electronically connected to the weapon trigger pressure sensor, the buttstock pressure sensor and the optic mounted camera, wherein, the reconfigurable data collector provides power to the weapon trigger pressure sensor, the buttstock pressure sensor and the optic camera, and wherein, the reconfigurable data collector receives transmitted video data from the weapon optic mounted camera and pressure sensor data from the trigger pressure sensor and the buttstock pressure sensor, correlates the data to determine an occurrence of a shot, and transmits the data to the remote data management and processing application.

2. The system of claim 1, wherein, the trigger pressure sensor comprises:

flat, flexible, force sensitive resistor with a top side and a bottom side;

a first flat, flexible protective sheet to cover the top side of the force sensitive resistor;

a second flat, flexible protective sheet to cover the bottom side of the force sensitive resistor; and an adhesive heat shrink tubing to secure the first and second flat flexible protective sheets to the respective top and bottom sides of the force sensitive resistor to creative one cohesive unit.

3. The system of claim 2 wherein, the flat, flexible, force sensitive resistor is divided into multiple zones to determine varying degrees of pressure applied to different parts of the weapon trigger.

4. The system of claim 2, wherein the first and second flat, flexible protective sheets are identical in shape to the flat flexible force sensitive resistor.

5. The system of claim 1, wherein the sensor cable is a weapon specific flexible flat cable that conforms to contours of the weapon.

6. The system of claim 1, wherein the trigger pressure sensor is identical in shape to the weapon trigger.

7. The system of claim 1, wherein the tail end of the sensor cable comprises a connector to connect to the electronic analysis device.

8. The system of claim 1, wherein the tail end of the sensor cable comprises a wireless transmitter to wirelessly transmit the trigger pressure sensor measurements.

9. The system of claim 1 where in a bottom half of the retainer has a slot for the weapon trigger and the trigger pressure sensor.

10. The system of claim 1, wherein the trigger pressure sensor comprises:

an insensitive bead region;

a sensitive body region; and an insensitive tail region, wherein, the insensitive head region of the trigger pressure sensor covers a space between a top part of the weapon trigger and the sensor cable and the insensitive tail region covers a space between a bottom portion of the weapon trigger and the a bottom half of the retainer, and wherein, the tail end of the trigger pressure sensor slides into a slot in the bottom half of the retainer.

11. The system of claim 1, wherein the trigger pressure sensor measurements can be either analog or digital.

12. The system of claim 1, wherein the weapon buttstock end mounted buttstock pressure sensor comprises:

a buttstock body, comprising an inner surface and an outer surface, wherein the buttstock body conforms, and is fixed to a buttstock end;

a buttstock pressure sensor affixed to the outer surface of the buttstock body;

a cover plate to cover the outer surface of the buttstock body and secure the buttstock pressure sensor in place on the outer surface of the buttstock body; and a connector affixed to the buttstock body, wherein the connector electronically connects the buttstock pressure sensor to a the reconfigurable data collector.

13. The system of claim 12, wherein the buttstock pressure sensor comprises:

a circuit board having a periphery, the circuit board hosts electronic intelligence required to perform buttstock pressure sensor data collection, storage and transmission;

a sensor platform, with connector slots, attached to the periphery of the circuit board; and multiple force sensitive resistors that and electronically attach to the circuit board through the connector slots to detect pressure applied to the outer surface of the buttstock body.

14. The system of claim 12, wherein the buttstock body includes flanges encasing a perimeter of the connector to prevent damaging lateral stresses.

15. The system of claim 12, wherein the buttstock body includes distal end cutouts to remove areas of the buttstock body that would otherwise absorb large flexural stresses that would damage the buttstock pressure sensor during weapon fire.

16. The system of claim 12, wherein the buttstock pressure sensor is divided into horizontally and vertically sensitive grid regions to more accurately determine location and distribution of applied pressure.

17. The system of claim 12, wherein the system further comprises accelerometers affixed to the inner surface of the buttstock body to measure weapon attitude.

18. The system of claim 12, wherein the system further comprises a high performance tracking sensor affixed to the inner surface of the buttstock body to measure the orientation and location of the weapon.

19. The system of claim 12, wherein the weapon buttstock is a M4/M16 style foxed buttstock.

20. The system of claim 12 wherein at least one magnet is affixed to the inner surface of the buttstock body, wherein the magnet engages with mounting screws at the weapon buttstock end to hold the buttstock body in place at the weapon buttstock end.

21. The system of claim 12 where slots are affixed to the inner surface of the buttstock body, to engage edges of the weapon buttstock to hold the buttstock body in place on the weapon buttstock end.

22. The system of claim 12 wherein several cantilever hooked beams are affixed to the inner surface of the buttstock body, to engage edges of the weapon buttstock to hold the buttstock body in place on the weapon buttstock end.

23. The system of claim 13, wherein the circuit board comprises:

a microcontroller; and a multi-channel analog-to-digital converter, wherein channels of the analog-to-digital converter are used to read the force sensitive resistors of the buttstock pressure sensor.

24. The system of claim 13, wherein the buttstock body includes bosses on the outer surface that support the circuit board, on the outer surface of buttstock body, to prevent applied pressure flexing and damage to the circuit board.

25. The system of claim 1 wherein the weapon optic mounted camera comprises:

a printed circuit board with a semiconductor image sensor;

a focusing lens, with a back end and a lens end;

a printed circuit board and the focusing lens housing with a top half and bottom half;

a beam splitter;

a beam splitter housing, with a front objective end and a rear objective end, a top half and a bottom half, wherein a portion of the top half of the beam splitter housing is connected to the printed circuit board and the focusing lens housing; and a double hinged cramping mount, with an inner surface, an outer surface, a top half and a bottom half, wherein the top half of the double hinged clamping mount is secured to the rear objective end of the beam splitter housing to mate the rear objective end of the beam splitter housing to the weapon optic mounted camera.

26. The system of claim 25, wherein the inner surface of the double hinged clamping mount is recessed.

27. The system of claim 25, wherein the inner surface of the double hinged clamping mount is lined with semi-compressible rubber pads.

28. The system of claim 25, wherein the semiconductor image sensor is a high definition Complementary Metal Oxide Semiconductor (CMOS) image sensor.

29. The system of claim 25, wherein the back end of the focusing lens is secured to the bottom half of the printed circuit board and focusing lens housing, and extends into an opening in the top half of the beam splitter housing.

30. The system of claim 25, wherein the beam splitter housing comprises:

a light path opening; and an interface mount for holding the beam splitter in place.

31. The system of claim 30, wherein the beam splitter housing light path opening is at least 1.10 inches in diameter.

32. The system of claim 31, wherein the beam splitter housing light path opening is aligned with the focusing lens.

33. The system of claim 25, wherein the beam splitter has a surface width greater than 8 mm.

34. The system of claim 25, wherein the beam splitter has a reflection/transmission ratio of either 50/50 or 30/70.

35. The system of claim 1, wherein the reconfigurable data collector comprises:

a body with a battery side and a weapon side; wherein the body comprises:

a main circuit board;

a microcontroller embedded on the main circuit board;

a wireless antenna embedded on the main circuit board; and a heat sink embedded on the main circuit board;

a battery that mounts to battery side of the body;

sensor connectors, at an end of the body, for connecting the remote reconfigurable data collector to sensors on other parts of the weapon;

a body cover that that attaches to the weapon side of the body; and a weapon mount attached to the body cover to mount the remote reconfigurable data collector to the weapon.

36. The system claim 35, wherein the body further comprises:

alignment guides on opposite longitudinal sides on the battery side of the body for aligning the battery on the body when mounted to the body;

mounting channels on the battery side of the body for mounting the battery to the body;

a battery retention slide channel on the battery side of the body;

a battery retention slide that fits into the battery retention slide channel on the battery side of the body to lock the battery into place;

a battery retention slide block on the battery side of the body to hold the battery retention slide in the battery retention slide channel;

battery retention slide block pin on the battery side of the body to hold the battery retention slide block in place;

spring loaded battery contacts on the battery side of the body to engage the battery and provide battery power to the main circuit board; and pin bushings on each side of one end of the body to accept a pin that connects the body cover to the body.

37. The system of claim 36, wherein the battery comprises:

a retention tang to lock the battery in place on the body; and alignment rails, located on each side of the battery, that slide into the alignment guides on opposite longitudinal sides of the battery side of the body, to secure the battery to the body.

38. The system of claim 36, wherein the body further comprises:

an LED status indicator for monitoring a device state; and a utility button for accessing initialization and test results.

39. The system of claim 36, wherein the body further comprises flanges surrounding the sensor connectors to protect the connectors from impacts and lateral stresses.

40. The system of claim 37, wherein the weapon mount is secured to the body with screws passed through holes in the weapon mount to engage threaded holes in an internal metal reinforcement bar of the body cover.

41. The system of claim 36, wherein the weapon mount is a weapon barrel-clamp mount.

42. The system of claim 41, wherein the weapon barrel-clamp mount comprises:

a mount body, wherein the mount body comprises:

a solid flat base; and clearance holes to accept screws;

a barrel strap, connected to the soled flat base, to be rotated over the weapon barrel;

a barrel clamp nut that can be rotated to capture the barrel strap to secure the weapon mount to the weapon barrel; and alignment tabs to engage a weapon bayonet lug to ensure the weapon barrel-clamp mount is directly beneath the weapon barrel.

43. The system of claim 36, wherein the weapon mount is a quick-disconnect rail mount with a mount body and a locking lever.

44. The system of claim 36, wherein the main body incudes a colored marker to indicate a purpose for each connectors.

45. The system of claim 36, wherein the body incudes an embossed ID number for identification.

46. The system-of claim 37, wherein the body cover comprises:

mounting guides for guiding the body cover into the mounting channels on the battery side of the body;

a mounting tab that provides a connection between the body cover and the body;

pin bushings on each side of one end of the body cover to accept a pin, to secure the body cover to the body;

a pin, with alignment grooves, that passes through the pin bushings on the body and the pin bushing on each side of one end of the body cover to connect the body to the body cover;

a spring-loaded ball detent, for engaging with the alignment grooves of the pin, to prevent the pin from dislodging during weapon fire; and an internal metal reinforcement bar for securing the weapon mount to the body cover.

47. The system claim 37, wherein each of the spring loaded battery contacts comprises:

a bushing to provide reinforcement of the body and ensure smooth motion of the spring loaded battery contacts;

battery contact pads;

a battery contact body that moves to engage the battery contact pads;

a wave spring to provide contact motion and force; and a battery wiring tab to provide a wiring point to deliver power to the main circuit board.

48. The system of claim 37, wherein each of spring loaded battery contacts are secured in place and held under tension by a battery contact cap.

* * * * *